US009752395B2

(12) United States Patent
Roodenburg et al.

(10) Patent No.: US 9,752,395 B2
(45) Date of Patent: Sep. 5, 2017

(54) WELLBORE DRILLING SYSTEM

(71) Applicant: ITREC B.V., Schiedam (NL)

(72) Inventors: Joop Roodenburg, Delft (NL); Diederick Bernardus Wijning, Schiedam (NL); Hendrik Hessels, Franeker (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/889,380

(22) PCT Filed: Mar. 3, 2014

(86) PCT No.: PCT/NL2014/050129
§ 371 (c)(1),
(2) Date: Nov. 5, 2015

(87) PCT Pub. No.: WO2014/182160
PCT Pub. Date: Nov. 13, 2014

(65) Prior Publication Data

US 2016/0090796 A1 Mar. 31, 2016

(30) Foreign Application Priority Data

May 6, 2013 (NL) ..... 1040202

(51) Int. Cl.
*E21B 19/14* (2006.01)
*B66F 11/00* (2006.01)
(Continued)

(52) U.S. Cl.
CPC ..... *E21B 19/06* (2013.01); *B63B 15/00* (2013.01); *B63B 35/4413* (2013.01);
(Continued)

(58) Field of Classification Search
CPC ..... E21B 19/146; E21B 19/14; E21B 15/02; E21B 19/002; E21B 19/02; E21B 19/087;
(Continued)

(56) References Cited

U.S. PATENT DOCUMENTS 3,501,017 A * 3/1970 Johnson ..... E21B 19/14 175/85
5,174,389 A * 12/1992 Hansen ..... E21B 19/146 175/52
(Continued)

FOREIGN PATENT DOCUMENTS

DE 10 2009 043 081 A1 3/2011
NL WO 2010126357 A8 * 12/2010 ..... E21B 19/146
(Continued)

*Primary Examiner* — Gregory Adams
(74) *Attorney, Agent, or Firm* — Birch, Stewart, Kolasch & Birch, LLP

(57) ABSTRACT

An aspect of the present invention relates to a wellbore drilling system comprising a drilling tower and a tubular racking device having at least a lower first tubular racker assembly and at least a second tubular racker assembly operable at a greater height than the first tubular racker assembly. The system further comprises one or more well center tools, each adapted for operation above the well center of the drill floor, e.g. an iron roughneck tool for making up and breaking out of threaded tubular joints. According to the present invention, the tubular racking device comprises a third tubular racker assembly which is vertically mobile and which is operable for tubular transfer between the firing line and the drilling tubulars storage rack in combination with the second tubular racker assembly, e.g. in case of failure of the first tubular racker assembly, and wherein at least one well center tool is adapted to be connected to the motion arm of the third tubular racker assembly, which well center tool is operable above the drill floor, whilst the first and second tubular racker assemblies
(Continued)

Figure 1:
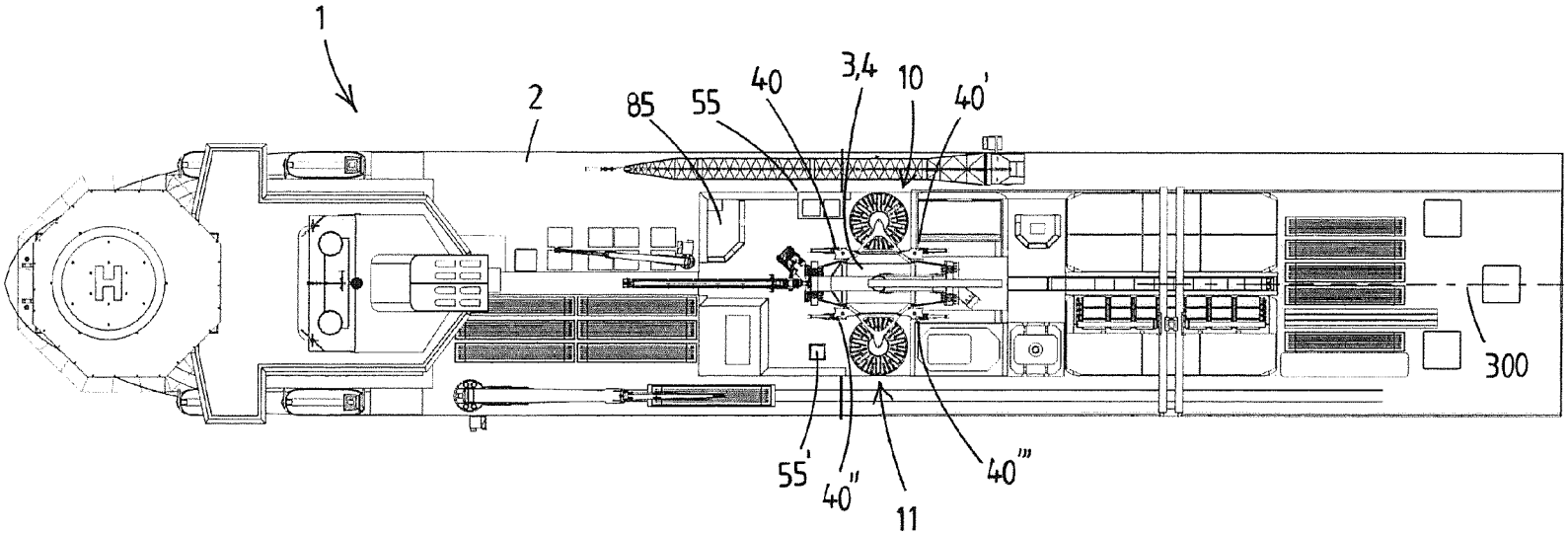

are operable in combination for tubular transfer between the firing line and the drilling tubulars storage rack.

17 Claims, 15 Drawing Sheets

(51) Int. Cl.

| | |
|---|---|
| ***E21B 19/06*** | (2006.01) |
| ***E21B 15/00*** | (2006.01) |
| ***E21B 15/02*** | (2006.01) |
| ***E21B 19/15*** | (2006.01) |
| ***B63B 15/00*** | (2006.01) |
| ***B63B 35/44*** | (2006.01) |
| ***E21B 19/20*** | (2006.01) |
| ***E21B 19/24*** | (2006.01) |

(52) U.S. Cl.
CPC ..... *E21B 15/00* (2013.01); *E21B 15/02* (2013.01); *E21B 19/14* (2013.01); *E21B 19/143* (2013.01); *E21B 19/146* (2013.01); *E21B 19/155* (2013.01); *E21B 19/20* (2013.01); *E21B 19/24* (2013.01); *B63B 2035/4473* (2013.01)

(58) Field of Classification Search
CPC ..... E21B 19/143; E21B 19/16; E21B 19/165; B63B 2003/147; B63B 21/507; B63B 27/04
USPC ..... 175/52, 85; 414/22.51–22.59, 414/22.61–22.69, 23, 24
See application file for complete search history.

(56) References Cited

U.S. PATENT DOCUMENTS

| | | | | |
|---|---|---|---|---|
| 6,715,569 | B1 * | 4/2004 | Rogers | B66C 23/16 166/379 |
| 6,763,898 | B1 * | 7/2004 | Roodenburg | E21B 15/00 166/358 |
| 7,178,612 | B2 | 2/2007 | Belik | |
| 7,841,415 | B2 * | 11/2010 | Winter | E21B 19/16 166/382 |
| 2009/0196712 | A1 * | 8/2009 | Mortensen | E21B 19/146 414/22.68 |
| 2010/0326672 | A1 | 12/2010 | Childers et al. | |
| 2011/0048310 | A1 * | 3/2011 | Roodenburg | B63B 35/4413 114/268 |
| 2012/0103623 | A1 | 5/2012 | Wijning et al. | |
| 2012/0305261 | A1 | 12/2012 | Roodenburg et al. | |
| 2014/0064883 | A1 * | 3/2014 | Sondervik | E21B 19/087 414/22.51 |

FOREIGN PATENT DOCUMENTS

| | | | | |
|---|---|---|---|---|
| NL | WO 2012087119 | A1 * | 6/2012 | E21B 15/02 |
| NO | WO 2012148285 | A1 * | 11/2012 | E21B 19/087 |
| WO | WO 02/18742 | A1 | 3/2002 | |
| WO | WO 2013/169099 | A2 | 11/2013 | |

* cited by examiner

WELLBORE DRILLING SYSTEM

The present invention relates to a wellbore drilling system and a method for drilling.

In the oil and gas well drilling industry numerous types of piping, referred to generally as "tubulars", are used. Tubulars include for instance drill pipes, casing pipes, and other connectable (e.g. by screwthread) oil and gas well pipe elements.

Commonly multiple single joints of drill pipe or other tubular are held together during drilling operations, e.g. during tripping operations. Most modern drilling rigs are capable of handling three-joint stands, called "triples", or even quadruple stands, called "quads (135 ft.)".

The present applicant has disclosed, e.g. in WO 02/18742, a wellbore drilling system that includes a tower fitted to the hull of a drilling vessel adjacent a moonpool. The tower is embodied as a mast.

The system comprises a drill floor, above the moonpool, having a well center through which a drill string passes along a firing line. A drill string rotary drive, e.g. a top drive, is provided to rotate a drill string for drilling operations.

For storage of drilling tubulars, preferably made up stands, e.g. triple stands, two drilling tubulars storage racks for tubulars are provided on opposite sides of the mast, wherein multiple drilling tubulars are stored in vertical orientation.

Adjacent each drilling tubulars storage rack a tubular racking device is mounted having at least a lower first tubular racker assembly and at least one second tubular racker assembly operable at a greater height than the first tubular racker assembly. Each tubular racker assembly comprises a base, a motion arm connected to the base, and a tubular gripper member connected to the motion arm and adapted to grip a tubular. The motion arm includes arm members and an actuator arrangement.

Each tubular racking device is adapted to grip and retain a drilling tubular by the tubular racker assemblies, wherein the weight of the tubulars is distributed over the motion arms of the tubular racker assemblies. Therefore the motion arms are very robust and can support a weight of at least several tons. The tubular racking device is adapted to place a tubular in and remove a tubular from the corresponding drilling tubulars storage rack.

Each tubular racking device has a reach that at least allows to transfer a tubular gripped by the first and second tubular racker assemblies between the drilling tubulars storage rack and a position of the tubular aligned with the firing line above the well center so as to allow for building and disassembly of a tubulars string, e.g. a drill string or a casing string.

The rotary racks are thus employed as setbacks, e.g. for drill pipe stands. In practice this means that for some drilling operations, in particular during a tripping operation, transfer of multi-joint tubulars between the firing line and the setbacks is performed at a high frequency.

Commonly, drilling operations require the use of one or more well center tools, each adapted for operation above the well center of the drill floor, e.g. an iron roughneck tool for making up and breaking out of threaded tubular joints. In WO02/18742, as is common, this iron roughneck is placed on rails that extend over the drill floor to the well center.

Instead of having an iron roughneck arranged on rails over the drill floor it is also known to support the iron roughneck on a dedicated well center tool supporting robot, which includes a motion arm adapted to support the weight of the well center tool. The motion arm allows to move the iron roughneck between a retracted position and an operative position above the well center. An example thereof is disclosed in U.S. Pat. No. 7,178,612. Whilst this well center tool supporting robot allows to do away with the drill floor rails for the iron roughneck, and provides for use with other well center tools as well, the robot is not entirely satisfactory.

The present invention aims to propose solutions that allow for increased operational efficiency and/or versatility of the system.

According to a first aspect of the invention a wellbore drilling system is proposed, comprising:

a drilling tower, a drill floor having a well center through which a drill string passes along a firing line, a drilling tubulars storage rack adapted to store multiple drilling tubulars in vertical orientation, preferably multi-jointed tubulars, a tubular racking device having at least a lower first tubular racker assembly and at least a second tubular racker assembly operable at a greater height than the first tubular racker assembly, each tubular racker assembly comprises a base, a motion arm connected to said base, and a tubular gripper member connected or connectable to the motion arm and adapted to grip a tubular, wherein the tubular racking device is adapted to grip and retain a drilling tubular by the tubular racker assemblies, wherein the weight of the tubular is distributed over the motion arms of the tubular racker assemblies, and wherein the tubular racking device is adapted to place a tubular in and remove a tubular from the drilling tubulars storage rack, and wherein the tubular racking device has a reach at least allowing to transfer a tubular gripped by said first and second tubular racker assemblies between the drilling tubulars storage rack and a position of the tubular aligned with the firing line above the well center so as to allow for building and disassembly of a tubulars string, e.g. a drill string or a casing string, wherein the system further comprises one or more well center tools, each adapted for operation above the well center of the drill floor, e.g. an iron roughneck tool for making up and breaking out of threaded tubular joints, which is characterized in that the base of the first tubular racker assembly is vertically mobile between a lower operative position, wherein the corresponding gripper member can place a tubular in and remove a tubular from the drilling tubulars storage rack, and a raised position, and in that the tubular racking device comprises a third tubular racker assembly comprising a base, a motion arm connected to said base, and a tubular gripper member connected or connectable to the motion arm and adapted to grip a tubular, wherein the base of the third tubular racker assembly is vertically mobile at least between a well center servicing position, that is below the lower operative position of the base of the first tubular racker assembly, and said lower operative position of the base of the first tubular racker assembly if said first tubular racker assembly is moved to a raised position, wherein—with the base of the third tubular racker assembly in said lower operative position of the base of the first tubular racker assembly and with a tubular gripper member connected to the motion arm—the third tubular racker assembly is operable for tubular transfer between the firing line and the drilling tubulars storage rack in combination with the second tubular racker assembly, e.g. in case of failure of the first tubular racker assembly, and in that at least one well center tool is adapted to be connected to the motion arm of the third tubular racker assembly, and in that—with the base of the third tubular racker assembly in the well center servicing position and a well center tool connected to the motion arm thereof—the well center tool is operable above the drill floor, whilst the first and second tubular racker assemblies are operable in combination for tubular transfer between the firing line and the drilling tubulars storage rack.

The first aspect of the invention thus envisages the provision of a third tubular racker assembly that is embodied with a "double functionality", namely as well center tool robot and as part of the tubular racking device, e.g. temporarily replacing the first tubular racker assembly when in repair or allowing for increased load capacity of the tubular racking device, e.g. when handling extra heavy tubulars. A possible advantage is the increased efficiency of drilling operations in general. There will be less flat time as it is possible to prepare a well center tool during tubular transfer (racking operation). Another advantage is the increased safety, e.g. because there are no longer well center tool drill floor rails required to transfer the well center tool to the firing line.

The versatility of the system may be increased by providing two tubular racking devices adjacent a tubulars storage rack, each tubular racking device comprising three tubular racking assemblies. For example, in operations using tapered strings, it is possible to have a tool adapted to the large diameter string provided at one tubular racking device, and a tool adapted to the smaller diameter string provided at the other tubular racking device. The provision of both tools 'stand-by' eliminates the necessity to change tools.

As wellbore drilling systems often also include storage of tubulars in horizontal position, e.g. in a hold and/or on deck of a drilling vessel, it is common to employ a so-called horizontal catwalk machine to assist in the transfer of tubulars, often to and from the firing line of the drilling rig system. As both this catwalk machine and the tubulars storage and handling system are preferably located in close vicinity to the firing line.

In an embodiment, the drilling tower is embodied as a derrick structure. Alternatively, the drilling tower is a mast.

In an embodiment, a first and a second drilling tubulars storage rack is provided, and wherein a first tubular racking device is arranged to transfer tubulars between the first drilling tubulars storage rack and the firing line, and wherein a second tubular racking device is arranged to transfer tubulars between the second drilling tubulars storage rack and the firing line. In an embodiment where the drilling tower is embodied as a mast, the first and second drilling tubular storage racks are preferably provided on opposite sides of the mast.

The first aspect of the invention is most advantageous in such an embodiment comprising two tubular drilling tubulars storage racks and two tubular racking devices, each being provided with the mentioned first, second and third tubular racker assemblies. The versatility of the system may be improved even further by providing two tubular racking devices adjacent each tubulars storage rack: hence, when four tubular racking devices are provided, two of which adjacent each drilling tubulars storage rack. Advantageously, each tubular racking device is provided with three tubular racking assemblies according to the present invention. As such, optimal use can be made of the versatility of the third tubular racker assemblies.

In an embodiment, the system further comprises a well center tools storage structure that is adapted to store therein the one or more well center tools that are connectable to the motion arm of the third tubular racker assembly. Well center tools that can possibly be stored in such a well center tools storage structure are:

- an iron roughneck for making up and breaking out of threaded tubular joint,
- a raised back-up system clamp adapted to clamp a drill string top end at an elevated position above the drill floor,
- a guide sheave for one or more lines to be introduced into the well bore,
- a thread doper adapted to clean a threaded tubular end and to dope the threaded tubular end,
- a mud bucket adapted to catch mud upon tripping in order to retrieve mud allowing for re-use of the mud,
- any type of end effector,
- a man basket,
- bolting tool,
- multibolt torque tool,
- centralizer tool for guiding risers,
- guide for drill pipes,
- a winch and hook.

Advantageously, the well center tools storage structure is adapted to store well center tools therein at multiple levels above one another. This reduces the footprint of the well center tools storage structure, which is particularly advantageous when the well center tools storage structure is provided on a deck of a vessel. In particular, as the base of the third tubular racker assembly is vertically mobile at least between a well center servicing position, that is below the lower operative position of the base of the first tubular racker assembly, and said lower operative position of the base of the first tubular racker assembly if said first tubular racker assembly is moved to a raised position, the height of the well center tools storage structure extends between this well center servicing position and at least the lower operative position (of the base of the first tubular racker assembly).

In an embodiment, said well center tools storage structure is arranged such that said one or more well center tools stored therein are within reach of the third tubular racker assembly so as to allow connection of a well center tool to the motion arm while the well center tool is stored in the well center tools storage structure. Hence, the well center tool can be connected to the tubular racker assembly at the well center storage structure, and therefrom transported by the same tubular racker assembly to the firing line, above the well center of the drill floor.

In an embodiment, it is also conceivable that said well center tools storage structure is arranged such that said one or more well center tools stored therein are within reach of the first tubular racker assembly, and that at least one well center tool is adapted to be connected to the motion arm of the first tubular racker assembly, so as to allow connection of a well center tool to the motion arm of the first racker assembly while the well center tool is stored in the well center tools storage structure. Hence, it is conceivable that a first well center tool is connected to the third tubular racker assembly, while a second well center tool is connected to the first tubular racker assembly. It is also conceivable that at least one well center tool is adapted to be connected to the motion arm of the first tubular racker assembly, allowing the well center tool to be operable above the drill floor in case of failure of the third tubular racker assembly. E.g., when handling risers, the upper end is gripped, while a centralizer tool for centralizing the riser is preferably provided at a lower racker assembly. When handling drill pipes, a lower end of the drill pipe is preferably gripped by a lower racker assembly, while an upper end of the drill pipe is being guided by an upper racker assembly.

According to the first aspect of the invention, at least one well center tool is adapted to be connected to the motion arm of the third tubular racker assembly. It is conceivable that the well center tool is adapted to be gripped by the tubular gripper member connected to the motion arm. Alternatively, the well center tool is adapted to be connected to said motion arm after prior removal of a tubular gripper member from the motion arm. Instead of the assemblies carrying a gripper member it is also possible that only one arm is provided with a gripper that supports the weight of the gripped tubular and the other arm carries a centralizer that holds the tubular in the upright position.

Optionally, a connector is arranged on the motion arm, wherein both the tubular gripper member and the well center tool are adapted to be connected to said connecter. Such a connector may e.g. be embodied with a hook, latch, stabbing plates, etc. etc. to ensure a firm and safe fit.

Optionally also power and control connection members are provided on the motion arm, e.g. with electric and/or fluid (e.g. hydraulic and/or pneumatic) connection members to supply electricity, control signals, and/or fluid power to the well center tool. These power and control connection members can be either separately or formed integral with the mechanical connector on the motion arm.

In an embodiment, a dedicated well center tool connector is arranged on the motion arm to mechanically connect the tool to the motion arm.

In an embodiment, the system comprises multiple well center tools having identical mechanical connectors that are connectable to the motion arm. These identical mechanical connectors may be connectable to a tubular gripper member, that is mounted on the motion arm, or to a connector provided on the motion arm, in particular a dedicated well center tool connector arranged on the motion arm.

It is conceivable that the well center tools to be used in conjunction with the system are provided with an identification, and optionally also a memory is provided comprising the use and/or history of such a well center tool. For example, a control unit is provided with such a memory and as such, the control unit knows what well center tool is installed where exactly, and also informed about operational details of the well center tool, such as the size of the tool.

In an embodiment comprising two tubular drilling tubulars storage racks and two tubular racking devices, each tubular racking device being provided with three tubular racker assemblies according to the first aspect of the present invention, two well center tool storage structures are preferably provided. In an embodiment, a first well center tool storage structure may be arranged such that said one or more well center tools stored therein are within reach of the first tubular racking device, and a second well center tool storage structure may be arranged such that said one or more well center tools stored therein are within reach of the second tubular racking device. Then, optimal use can be made of the versatility of the third tubular racker assemblies.

For example, the system may comprise a first and a second iron roughneck device. The provision of two iron roughneck devices, preferably having identical mechanical connectors to allow for releasable connection to a motion arm, allows for example to set one iron roughneck to the handling of tubulars having a first diameter and set the other iron roughneck to the handling of tubulars having a different second diameter. For example it is envisaged that the first iron roughneck is in operative position above the well center in the course of an assembly or disassembly process of a tubular string with a first diameter in the firing line, whilst, during said process involving the first iron roughneck, the second iron roughneck is already set to handle different diameter tubulars. If, as is preferred, two assemblies with motion arms are present near the drill floor, the second iron roughneck can be moved into the operative position directly after the first iron roughneck is retracted, which thus allows to switch to another diameter tubular handled in the firing line without delay. In the common prior art practice a single iron roughneck device is available for use on the drill floor, e.g. held by a robot arm as in U.S. Pat. No. 7,178,612, and changing thereof to a different diameter may take about 45 minutes. As these changes occur frequently these seemingly short delays in the handling tubular strings may accrue to a very significant total time expenditure, e.g. of one or even multiple days for a single drilling project and thus be very costly.

It is also advantageous to provide the first and second iron roughneck devices both in the firing line, wherein one is provided at an elevated position. This allows standbuilding, i.e. the assembly of single joints, above deck, instead of using a so-called mouse-hole for this process.

It will be appreciated that the provision of two assemblies with a motion arm and two iron roughnecks to be supported by said assemblies can also be advantageous in an embodiment wherein said two assemblies are not part of a system as described in the first aspect of the invention. For example the two assemblies with motion arm are then deck mounted stand-alone assemblies, or assemblies that are each mounted, as sole mobile assembly, on a corresponding relatively short vertical rails that is mounted to a drilling mast at the side facing the drill floor.

In a preferred embodiment a first iron roughneck device is stored in a first well center tool storage structure, and a second iron roughneck device is stored in a second well center tool storage structure. For example the two well center tool storage structures are arranged at opposite sides of the drill floor. In an alternative embodiment, an iron roughneck storage is envisaged at an elevated position, preferably within the construction of the drilling tower. For example, the iron roughneck storage is provided in a storage room inside a mast, or the iron roughneck storage is provided on a cross-beam of a lattice-type tower construction.

According to the first aspect of the present invention, the tubular racking device has at least three tubular racker assemblies each comprising a base. The base of the first tubular racker assembly is vertically mobile between a lower operative position and a raised position. The base of the third tubular racker assembly is also vertically mobile, at least between a well center servicing position, that is below the lower operative position of the base of the first tubular racker assembly, and said lower operative position of the base of the first tubular racker assembly. In a preferred embodiment the base of the second racker assembly is also vertically mobile. As preferred, all mobile bases are mounted on a common vertical rails.

In an embodiment, the bases of all tubular racker assemblies of a racker device are vertically mobile. It is conceivable that the base of the second tubular racker assembly is mobile between said raised position of the base of the first tubular racker assembly and an elevated position.

In an embodiment, the vertically mobile tubular racker assemblies of a tubular racking device are provided with a base that is guided along a vertical rails. Preferably a tubular racking device comprises one vertical rails along which all mobile bases are vertically guided.

In an embodiment, the tubular racking device includes a vertical column member provided with said one or more rails, said column member supporting said tubular racker assemblies.

In an embodiment where the drilling tower is embodied as a mast, it is conceivable that the vertical column member is formed integral with, or provided on or connected to the mast. Optionally, the vertical column member is provided rotatable, e.g. by providing a bearing between the mast and the vertical column member, or by mounting the vertical column member on a rotary support. In a practical embodiment the rotary support of the column members includes a base member to which the column members are connected with their lower end and a top member to which the column members are connected with their upper end. In particular, in an embodiment where the drilling tower is embodied as a mast, it is conceivable that each vertical rails, or a pair of parallel vertical rails in case of two racker devices, are directly provided on or connected to the mast. For example the mast has corners, and the vertical rails of two racker devices are arranged at the corners of the side of the mast facing the drill floor.

In an embodiment, the wellbore drilling system is furthermore provided with a drill string rotary drive, e.g. a top drive, adapted to rotate a drill string for drilling operation.

In an embodiment the motion arm is a telescopic extensible arm, the arm having a first arm segment which is connected to the base via a vertical axis bearing allowing the motion arm to revolve about this vertical axis. Preferably this vertical axis forms the only axis of revolution of the motion arm, which leads to a simple structure that can support a significant load. The motion arm the has one or more telescoping additional arm segments, with an outer arm segment being provided with a connector for a tubular gripper and/or a well center tool.

In an embodiment a hydraulic cylinder is present between segments of the arm, the cylinder being operable to cause extension and retraction of the arm. For example the racker assembly is provided with a self-contained hydraulic unit including an electric motor driven pump, a tank, and valves.

In an embodiment each tubular racking device comprises a vertical guide rails onto which corresponding guide members of the base of each tubular racker assembly engage. The tubular racker device further comprises a vertical toothed rack arranged parallel to this vertical guide rails. The base of the tubular racker assembly is provided with one or more pinions engaging with this vertical toothed rack and the base is provided with one or more motors driving the one or more pinions, so as to controlled vertical motion of the racker assembly. Preferably the one or more motors driving the one or more pinions are electric motors. In an embodiment a supercapacitor is included in an electric power circuit feeding said one or more vertical motion motors, which allows the temporary storage of electricity that may be generated by said one or more motors during a downward motion of the assembly. This energy can then be used for the upward motion again.

In an embodiment the system comprises an electrical heave motion compensation controller, that is linked to the vertical drive of the base of one or more of the vertically mobile motion arm or racker arm assemblies, the heave motion controller providing to said one or more vertical drives, e.g. to the pinion driving motors, a control signal representing a heave compensation motion of the one or more motion arm assemblies. This allows to obtain heave motion compensation of the tubular gripper or well center tool held by the respective motion arm. This embodiment is, for example, in combination with a heave motion compensated drill floor, e.g. as disclosed in WO2013/169099. For example a motion arm assembly can then be employed to hold a component of a coiled tubing injector device in a position above the well center whilst the drill floor is in heave compensation mode. Of course other heave motion compensation arrangements of the drill floor can also be envisaged in combination with the present invention.

In an embodiment said first, second, and third motion arm or racker arm assemblies are all connected to the electrical heave motion compensation controller, allowing all operations thereof to be done whilst performing heave compensation motion, e.g. in conjunction with a heave motion performing drill floor.

In particular when heave motion compensation mode of one or more of the mobile motion arm assemblies is envisaged, the electric power supply may be provided with a supercapacitor, even such a capacitor mounted on the base itself, for temporary storage of electric energy in the downward motion and use thereof for the upward motion.

In an embodiment wherein the mobile base of each mobile motion arm or racker arm assembly engages with a pinion on a vertical rack, one may provide heave motion compensation also by bringing said vertical toothed rack into heave compensation motion, e.g. the toothed rack being slidable along the tower or mast and with a vertical drive connected to the rail, or with the rail being connected to another object that is brought into heave compensation mode. For example one could envisage that the toothed rack is connected to the drill floor, with the drill floor being operable in heave compensation mode so that the toothed rack follows the drill floor.

In an embodiment the drilling tower is provided with two parallel tubular racking devices adjacent the drill floor, each racking device comprising a vertical rails and being provided with at least two tubular racker assemblies, the racker assemblies of each of said racking devices having a reach to bring a tubular gripper member connected to the motion arm of said racker assembly or another well center tool to a position aligned with the firing line above the well center.

In an embodiment of the racker assembly the vertical axis bearing between the base and the motion arm is arranged in a bearing housing that is releasably attached to the base of the racker assembly. Preferably the base provides both a left-hand attachment position and a right-hand attachment position for the bearing housing which allows in a suitable embodiment to use the same base in an drilling system with two parallel racking devices near the drill floor.

In an embodiment, the drilling tubulars storage rack is a drilling tubulars rotary storage rack that is rotatable about a vertical axis and has storage slots for storage of multiple tubulars in vertical orientation, the drilling tubulars rotary storage rack including a drive to rotate the drilling tubulars storage rack about its vertical axis. Optionally, the drilling tubulars rotary storage rack comprises a central vertical post and multiple discs at different heights on the post, at least one disc being a fingerboard disc having tubulars storage slots, each slot having an opening at an outer circumference of the fingerboard disc allowing to introduce and remove a tubular from the storage slot, wherein at least one fingerboard disc is composed of multiple fingerboard disc members that are releasably connected to the central post, e.g. by bolts, and wherein preferably a finger board disc member is provided with a latching device adapted to latch each individual tubular held in a slot of the fingerboard disc member.

In an embodiment, at least one tubular racker assembly is vertically mobile and is embodied to retain a finger board disc member during mounting and/or dismounting of the fingerboard disc member from the vertical post, e.g. the motion arm being provided with a gripper member adapted to grip the fingerboard disc member, and wherein the tubular racker assembly is used for vertical transportation of the gripped fingerboard disc member.

According to a second aspect of the invention, a wellbore drilling system is provided comprising:

a drilling tower, a drill floor having a well center through which a drill string passes along a firing line, a drilling tubulars rotary storage rack adapted to store multiple drilling tubulars in vertical orientation, preferably multi-jointed tubulars, said drilling tubulars rotary storage rack being rotatable about a vertical axis and having storage slots for storage of multiple tubulars in vertical orientation, the drilling tubulars rotary storage rack including a drive to rotate the drilling tubulars storage rack about its vertical axis, said drilling tubulars rotary storage rack comprising a central vertical post and multiple discs at different heights on the post, at least one disc being a fingerboard disc having tubulars storage slots, each slot having an opening at an outer circumference of the fingerboard disc allowing to introduce and remove a tubular from the storage slot, a tubular racking device having at least a lower first tubular racker assembly and at least a second tubular racker assembly operable at a greater height than the first tubular racker assembly, each tubular racker assembly comprises a base, a motion arm connected to said base, and a tubular gripper member connected or connectable to the motion arm and adapted to grip a tubular, wherein the tubular racking device is adapted to grip and retain a drilling tubular by the tubular racker assemblies, and wherein the tubular racking device is adapted to place a tubular in and remove a tubular from the drilling tubulars rotary storage rack, and wherein the tubular racking device has a reach at least allowing to transfer a tubular gripped by said first and second tubular racker assemblies between the drilling tubulars rotary storage rack and a position of the tubular aligned with the firing line above the well center so as to allow for building and disassembly of a tubulars string, e.g. a drill string or a casing string, which is characterized in that the at least one fingerboard disc is composed of multiple fingerboard disc members that are releasably connected to the central post, e.g. by bolts.

The second aspect of the invention also relates to a method for exchange of fingerboard disc members wherein use is made of a wellbore drilling system according to claim 16.

In an embodiment, a method for exchange of fingerboard disc members comprises the following steps:

retaining one or more first fingerboard disc members which are connected to the central post, e.g. by an auxiliary crane or by tubular racker assembly, dismounting the first fingerboard disc members from the vertical post, transporting the first fingerboard disc members from the vertical post to a remote location, e.g. by the auxiliary crane or by the tubular racker assembly, gripping one or more second fingerboard disc members which are to be connected to the central post, e.g. by the auxiliary crane or by the tubular racker assembly, transporting the second fingerboard disc members to the vertical post, e.g. by the auxiliary crane or by the tubular racker assembly, mounting the second fingerboard disc members to the vertical post.

Hence, in an embodiment it is conceivable that an auxiliary crane is provided for retaining, gripping and transporting the fingerboard disc members.

In an alternative embodiment, at least one tubular racker assembly is provided vertically mobile, and is embodied to retain a fingerboard disc member during mounting and/or dismounting of the fingerboard disc member from the vertical post, e.g. the motion arm being provided with a gripper member adapted to grip the fingerboard disc member, and wherein the tubular racker assembly is used for vertical transportation of the gripped fingerboard disc member. This is advantageous as there is no need for an additional device, as the tubular racker assemblies are already available. Such an embodiment may be particular advantageous in combination with a wellbore drilling system according to the first aspect of the invention, according to which three tubular racker assemblies are provided.

In an embodiment, a finger board disc member is provided with a latching device adapted to latch each individual tubular held in a slot of the fingerboard disc member.

In an embodiment, the drilling tubular storage rack comprises multiple corresponding releasably connected fingerboard disc members provided at different heights on the post, which disc members are provided with corresponding tubular storage slots and which are adapted to store one or more drilling tubulars in combination.

In an embodiment, the wellbore drilling system is furthermore provided with a drill string rotary drive, e.g. a top drive, adapted to rotate a drill string for drilling operation.

According to a third aspect of the invention a wellbore drilling system according to the preamble of claim 1 is proposed, which is characterized in that at least one well center tool is adapted to be connected to the motion arm of the lower tubular racker assembly. The third aspect of the invention thus envisages the provision of a tubular racker assembly that is embodied with a "double functionality", namely as well center tool robot and as part of the tubular racking device. A possible advantage is the increased efficiency of drilling operations in general. Another advantage is the increased safety, e.g. because there are no longer well center tool rails on the drill floor are required to transfer the well center tool to the firing line.

The versatility of the system may be improved by providing two tubular racking devices adjacent a tubulars storage rack, each tubular racking device comprising a lower tubular racking assembly which may be provided with such a well center tool. One racking device may be used for pipe racking, while the lower tubular racking assembly of the second racking device may be provided with the required well center tool.

Similar to the first aspect of the invention, in the third aspect of the invention the well center tool is adapted to be connected to the motion arm of a tubular racker assembly. It is conceivable that the well center tool is adapted to be gripped by the tubular gripper member connected to the motion arm. Alternatively, the well center tool is adapted to be connected to said motion arm after prior removal of a tubular gripper member from the motion arm. Optionally, a connector is arranged on the motion arm, wherein both the tubular gripper member and the well center tool are adapted to be connected to said connecter.

The invention also relates to a tubular racking and well center tool handling device comprising:

a vertical rails, at least two motion arm assemblies mounted on said vertical rails, wherein each motion arm assembly comprises a base that is vertically mobile along said vertical rails by a vertical drive, and a motion arm connected to said base, the motion arm having a mechanical connector.

In an embodiment the motors of the vertical drives are connected to a heave motion compensation controller.

In an embodiment the vertical rails comprises a vertical toothed rack, with each mobile base having one or more motor driven pinions engaging said toothed rack.

In an embodiment the toothed rack is vertically mobile so as to perform a heave compensating motion, e.g. when connected to a dedicated vertical drive of the toothed rack or when connected to another component that is or can be brought in heave compensation motion, e.g. to a heave compensated drill floor or a travelling block of heave compensated drawworks.

In an embodiment the motion arm is a telescopic extensible arm, the arm having a first arm segment which is connected to the base via a vertical axis bearing allowing the motion arm to revolve about said vertical axis, preferably said vertical axis forming the only axis of revolution of said arm, and wherein said arm comprising one or more telescoping additional arm segments.

In an embodiment the device comprises a vertical guide rails onto which corresponding guide members of the base of each motion arm assembly engage, and wherein the device further comprises a vertical toothed rack arranged parallel to said vertical guide rails, wherein the base of the tubular racker assembly is provided with one or more pinions engaging said vertical toothed rack, the base being provided with one or more motors driving said one or more pinions, preferably one or more electric motors.

In an embodiment the vertical axis bearing is arranged in a bearing housing that is releasably attached to the base of the assembly, the base providing a left-hand attachment position and a right-hand attachment position for the bearing housing.

One or more of the motion arm assemblies of this device may further have any one or more of the structural details and functionalities as described herein.

As is preferred the bases of the assemblies are identical, allowing to reduce the number of spare parts and allowing to use the one assembly as a (temporary) replacement for another assembly, possibly without having to remove an assembly that has broken down from the vertical rail.

The invention also relates to a system comprising a tubular racking and well center tool handling device, wherein the system further comprises:

a first tubular gripper and a second tubular gripper, said grippers each having a mechanical connector adapted to connect to a mechanical connector of a motion arm, a well center tool, e.g. an iron roughneck, having a mechanical connector adapted to connect to a mechanical connector of a motion arm.

The present invention also relates to a drilling tower, e.g. a mast, provided with two tubular racking and well center tool handling devices as described herein. For example the mast is arranged between two tubulars storage racks, with each of said devices being operable for tubulars transfer between an associated rack and the firing line using two of its motion arm assemblies, and with a third, lowermost assembly, being operable as well center tool supporting motion arm. For example the drilling tower is combined with two well center tool storage structures, each within reach of the motion arm of the respective device, e.g. at opposite sides of a drill floor.

The invention also relates to a well center tool handling system comprising two well center tool handling devices for use at a drill floor having a well center, each comprising:

a vertical rails, a motion arm assembly mounted on said vertical rails, wherein each motion arm assembly comprises a base that is vertically mobile along said vertical rails by a vertical drive, and a motion arm connected to said base, the motion arm having a mechanical connector for a well center tool, at least including an iron roughneck, wherein the system further comprises two well center tool storage structures, each within reach of the motion arm of the respective well center tool handling device, e.g. at opposite sides of a drill floor, and wherein the system further comprises a first iron roughneck and a second iron roughneck, wherein the motion arms are embodied to connect to a well center tool whilst stored in the storage structure and to transfer the connected well center tool to an operative position above the well center.

As is preferred, the same vertical rails of each well center tool handling device extends upwards so far that two additional motion arm assemblies are mounted on said rails, which additional motion arm assemblies are provided with tubular gripper members allowing to transfer tubulars between a tubulars storage and the firing line.

The well center tool handling system e.g. allows for a timesaving method wherein one of the motion arms is provided with the first iron roughneck device, which is then used in the process of assembly or disassembly of a tubular string in the firing line, whilst the second iron roughneck is during that process already set to handle different diameter tubulars than the ones handled by the first iron roughneck. As soon as the first iron roughneck is no longer needed, this first iron roughneck is retracted and the other motion arm is operated to move the prepared second iron roughneck into position above the well center. Thereby no time is wasted when switching between different diameter tubulars. The present invention also relates to this method.

Figure 2:
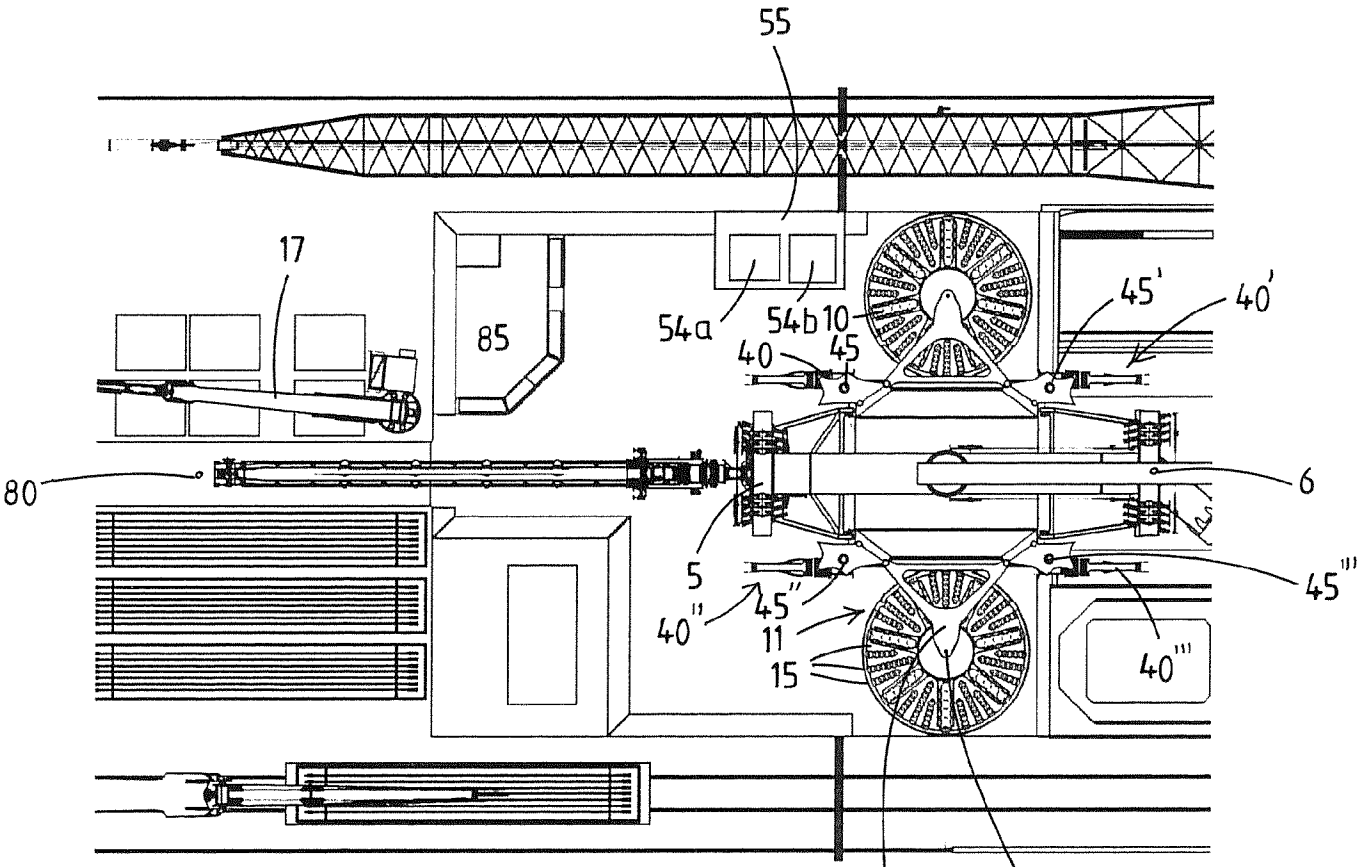
Figure 3:
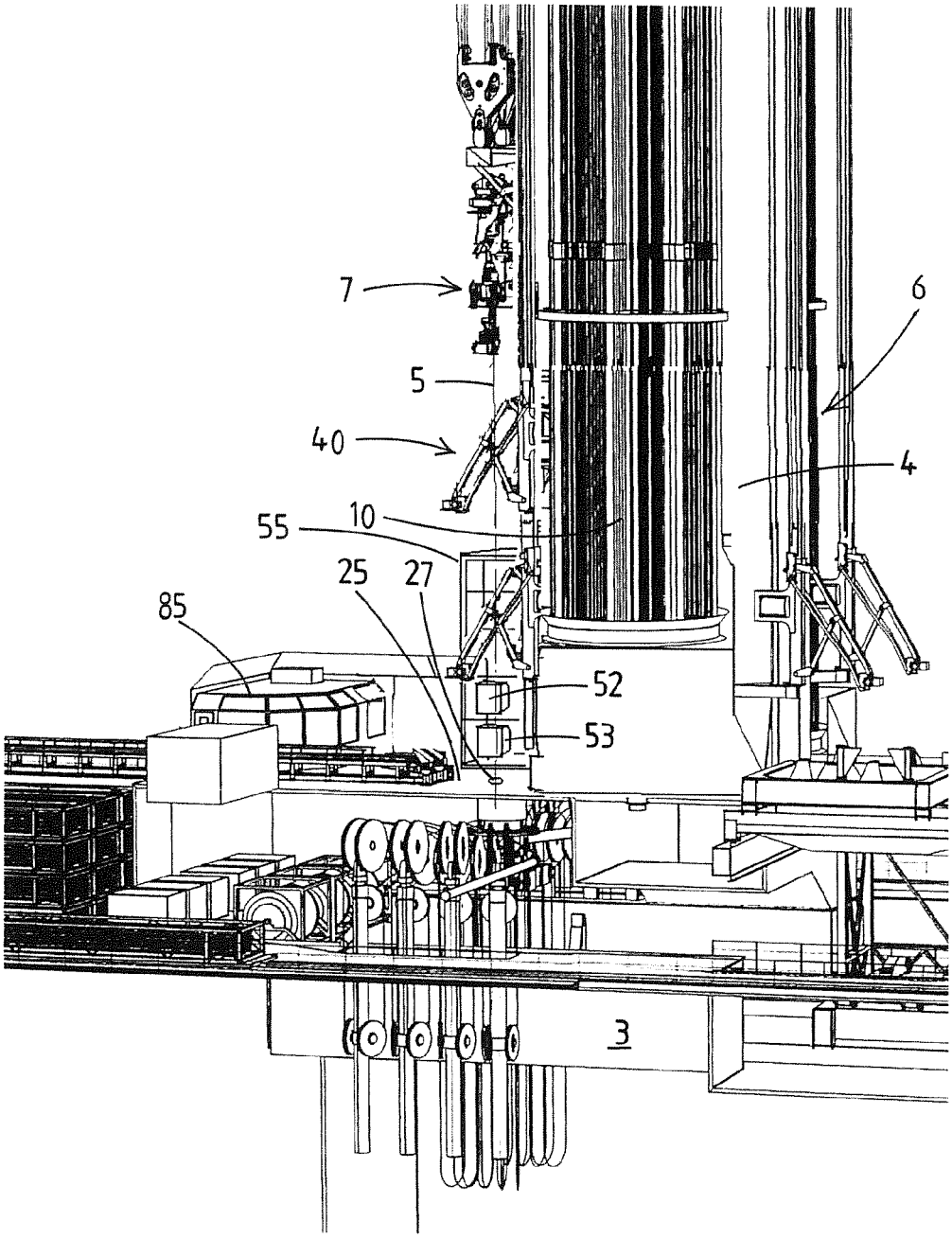
Figure 4:
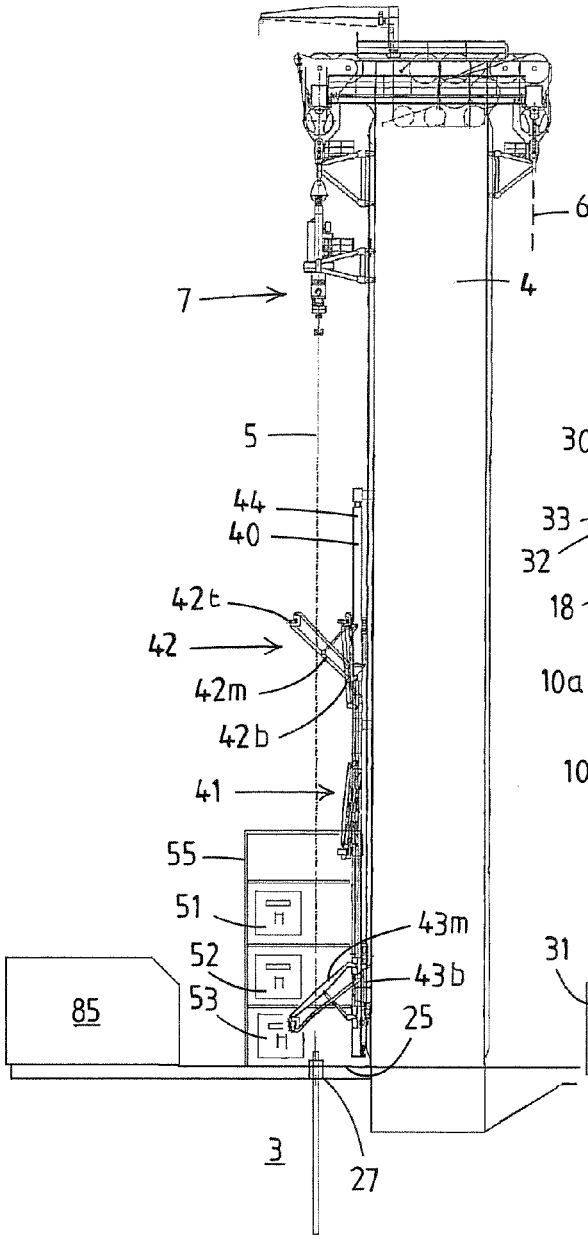
Figure 5:
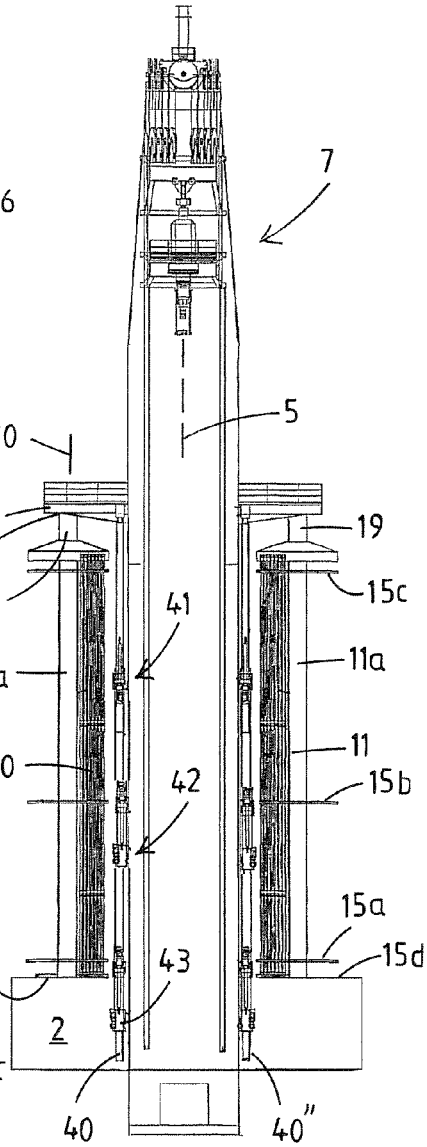
Figure 6:
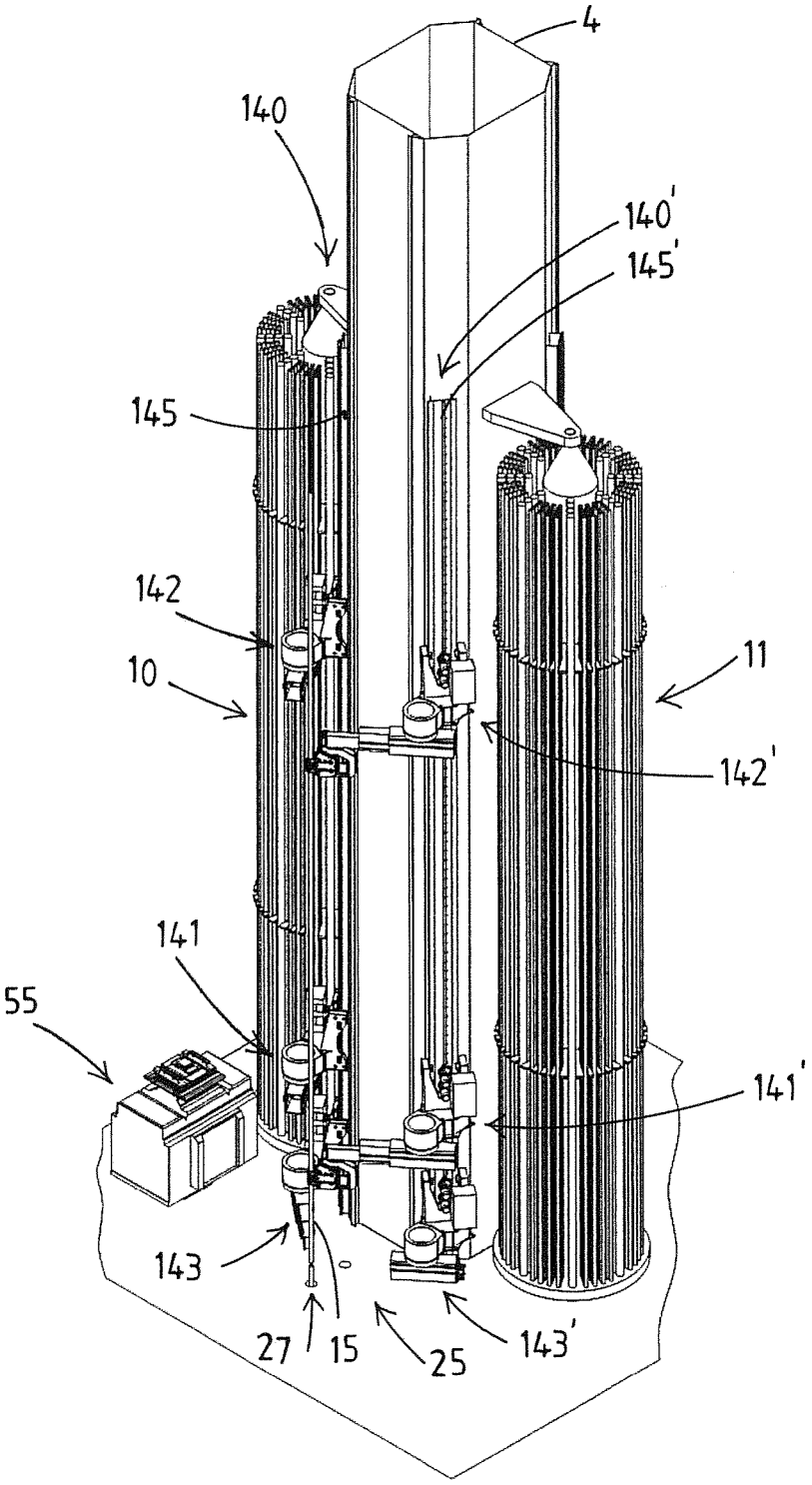
Figure 7:
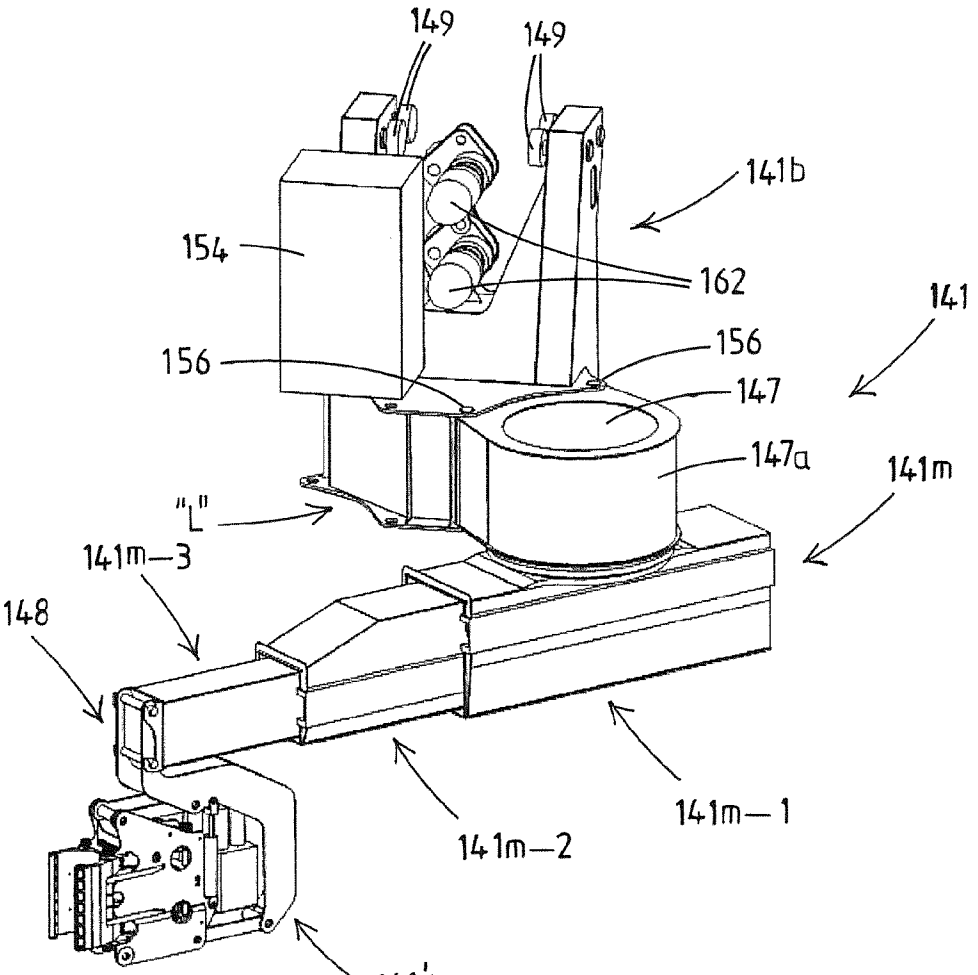
Figure 8:
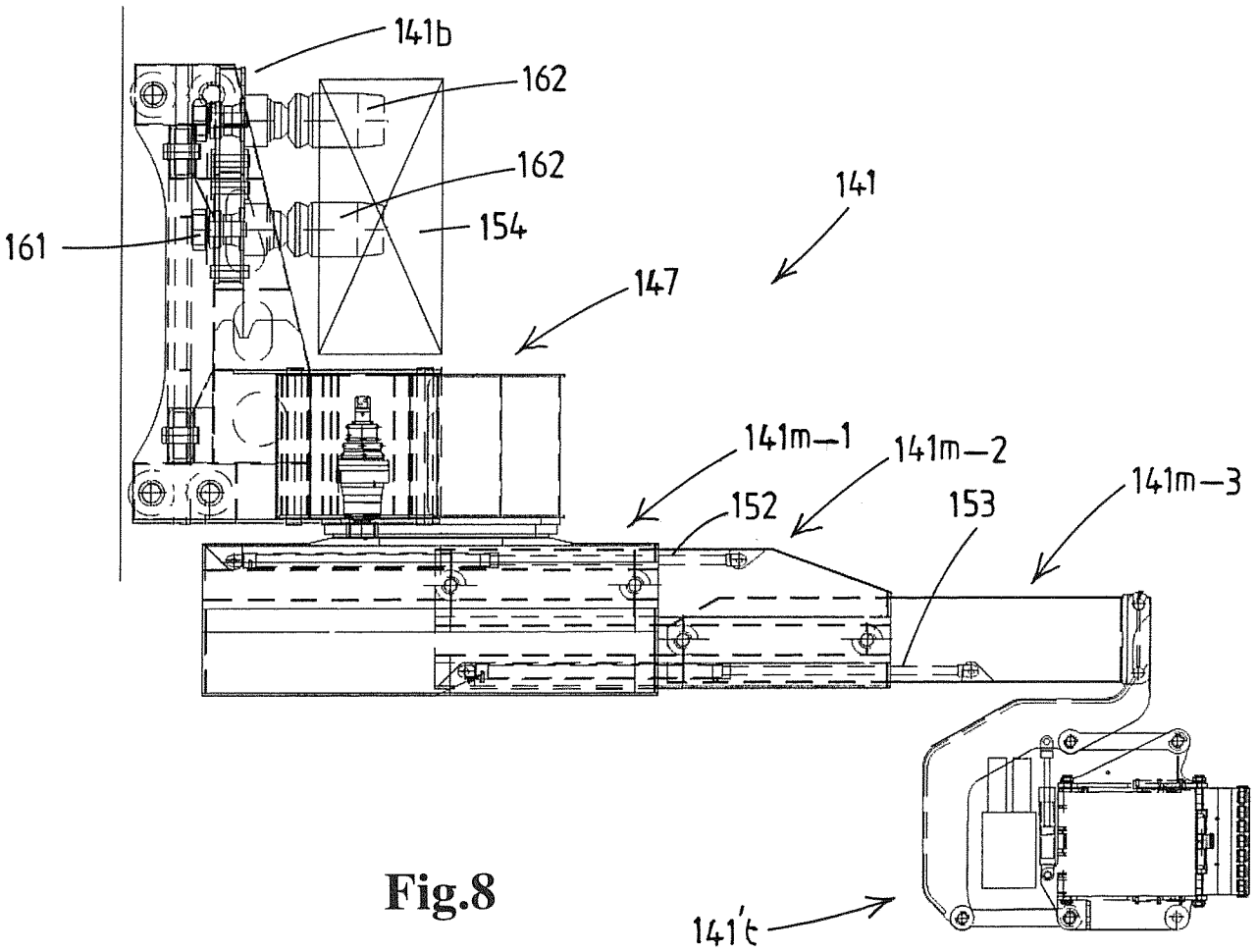
Figure 9:
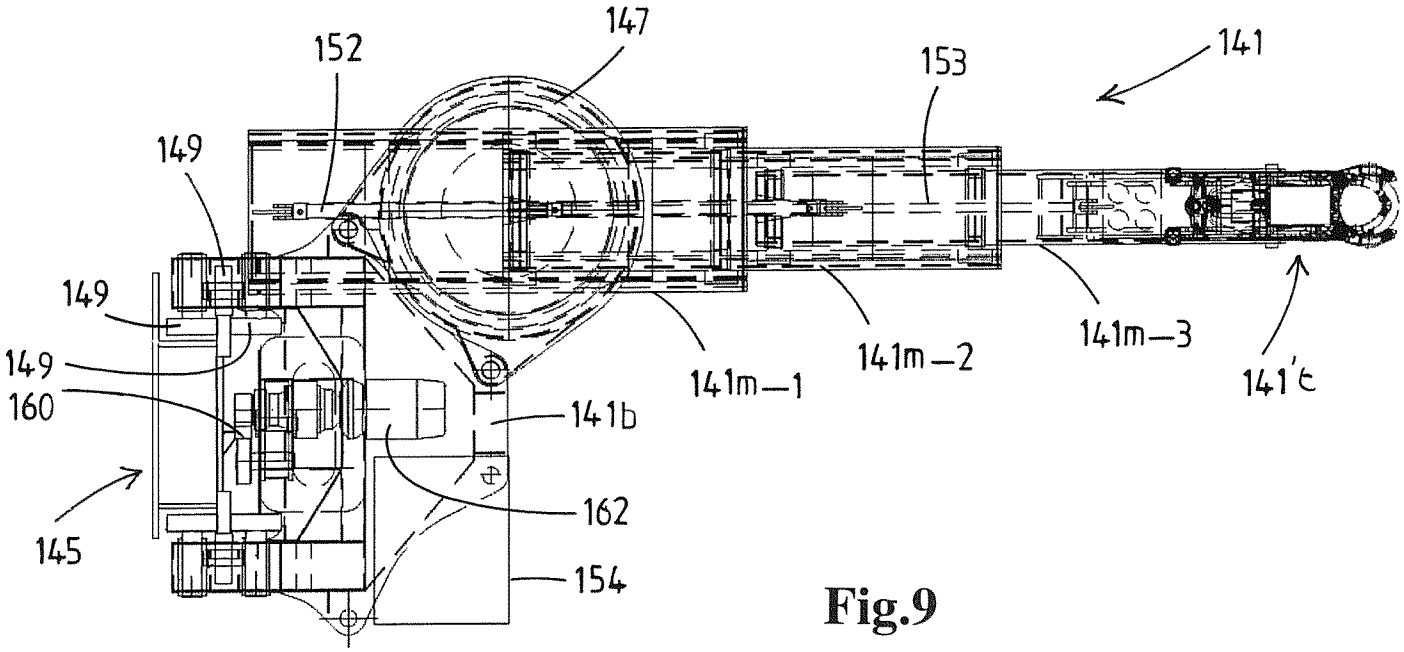
Figure 10:
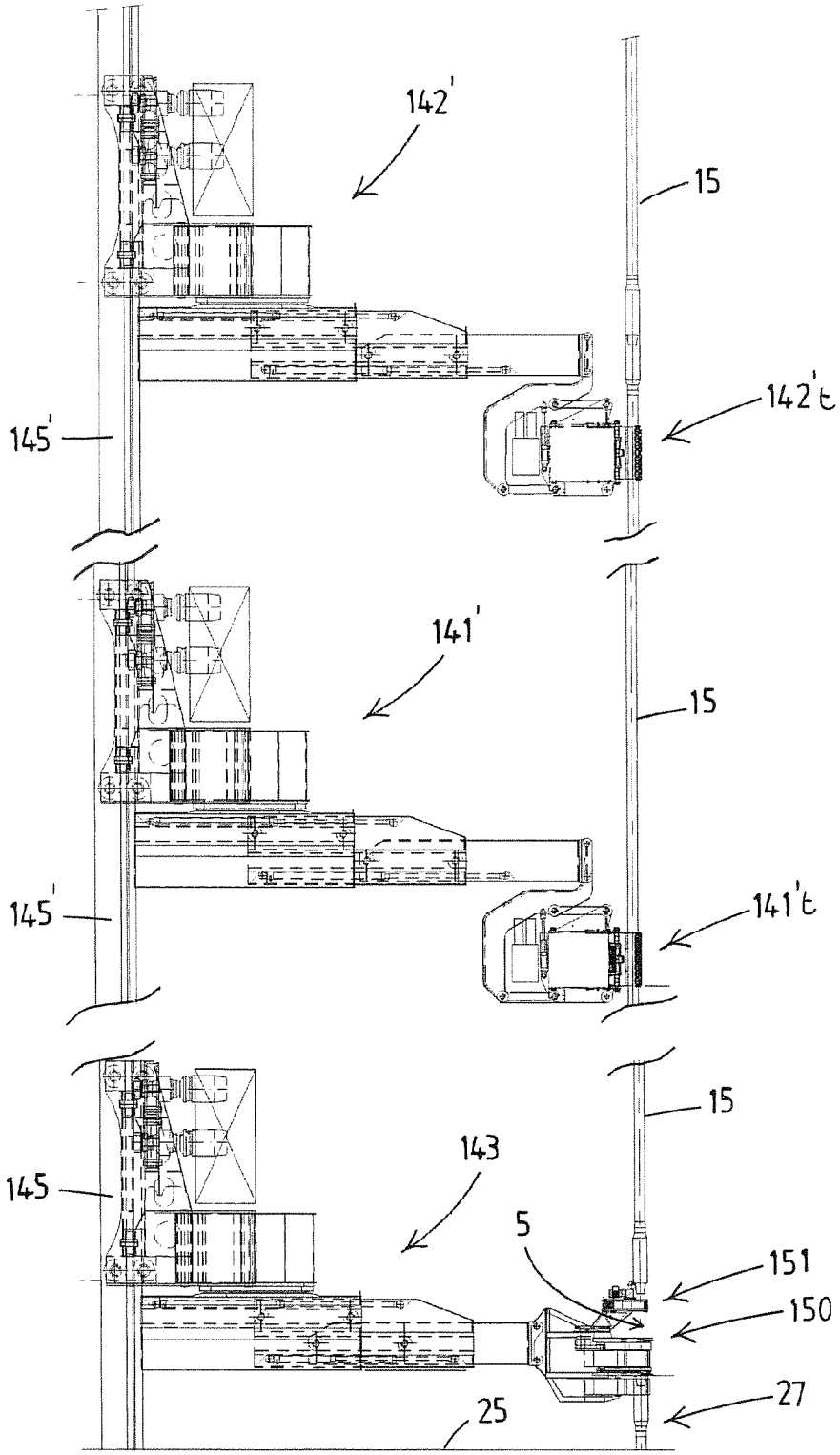
Figure 11:
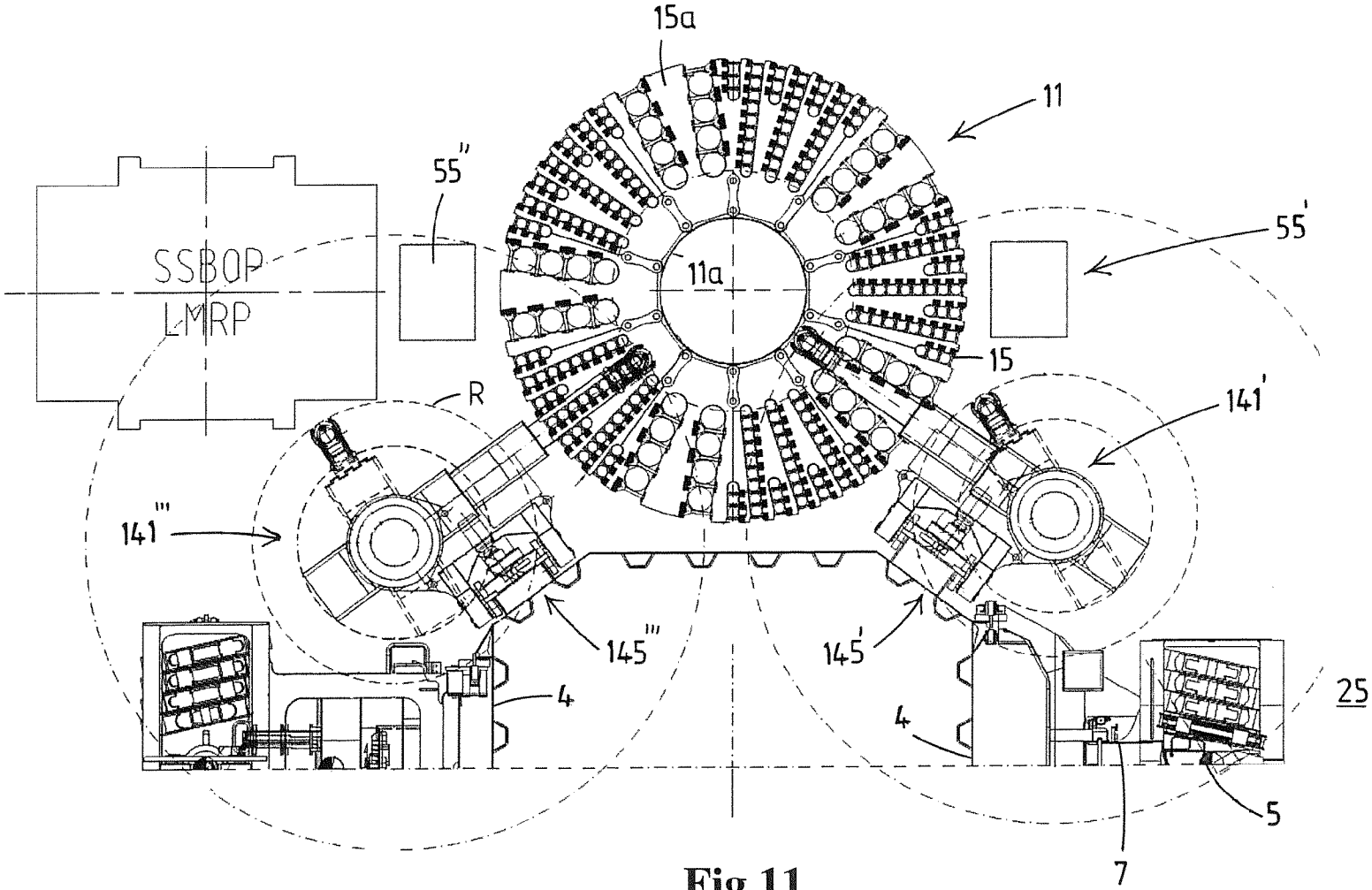
Figure 12:
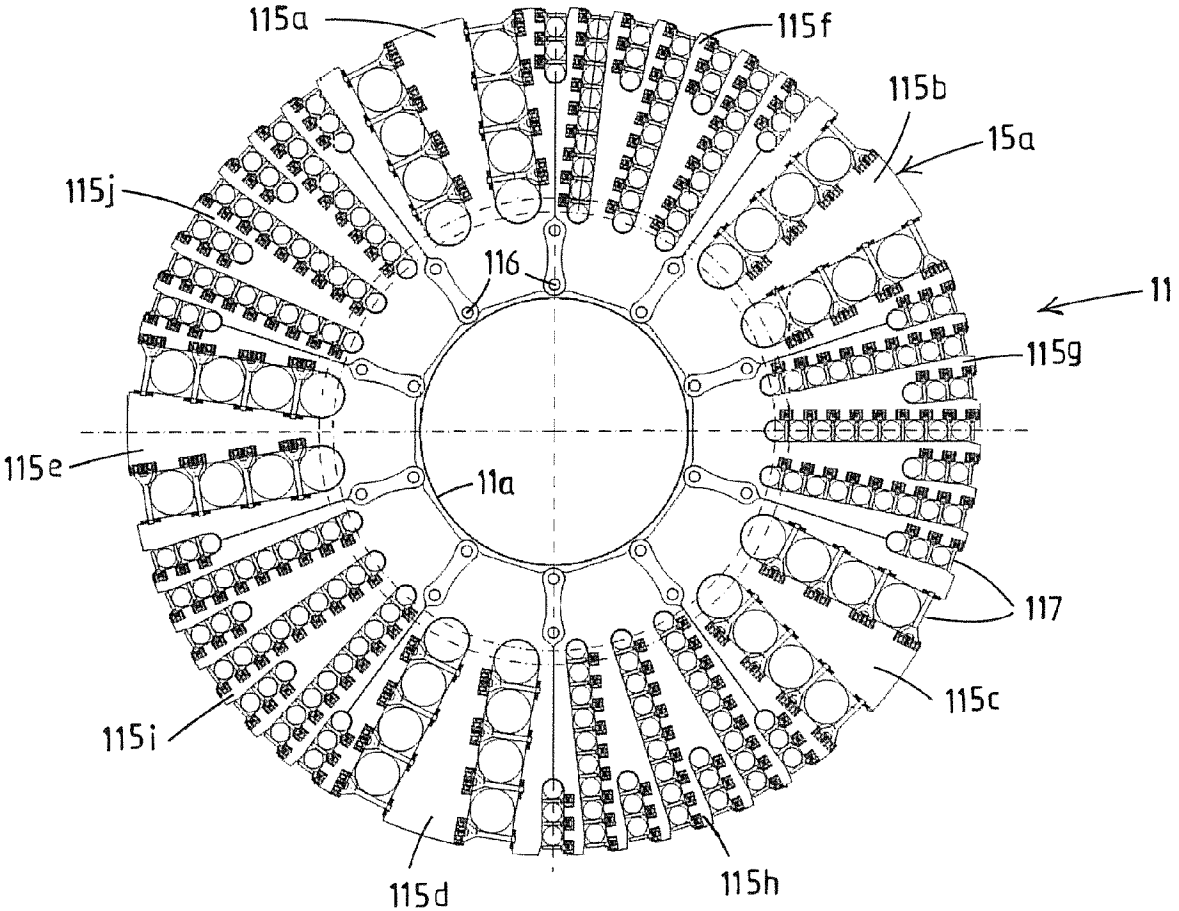
Figure 13A:
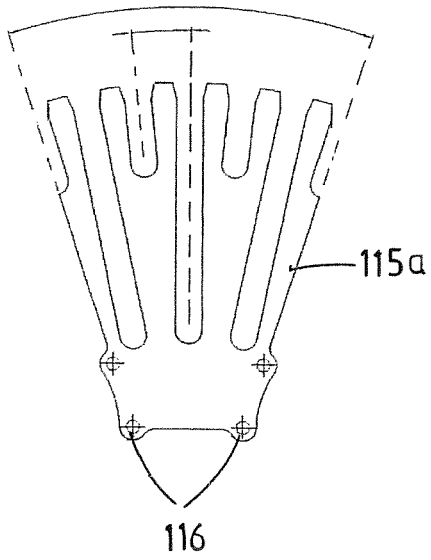
Figure 14A:
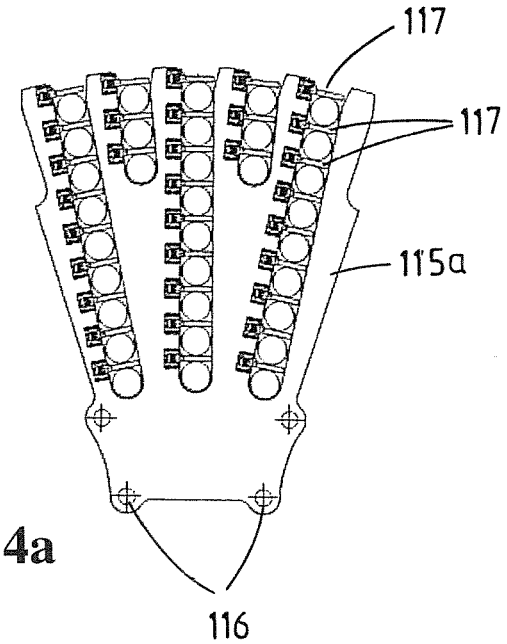
Figure 15:
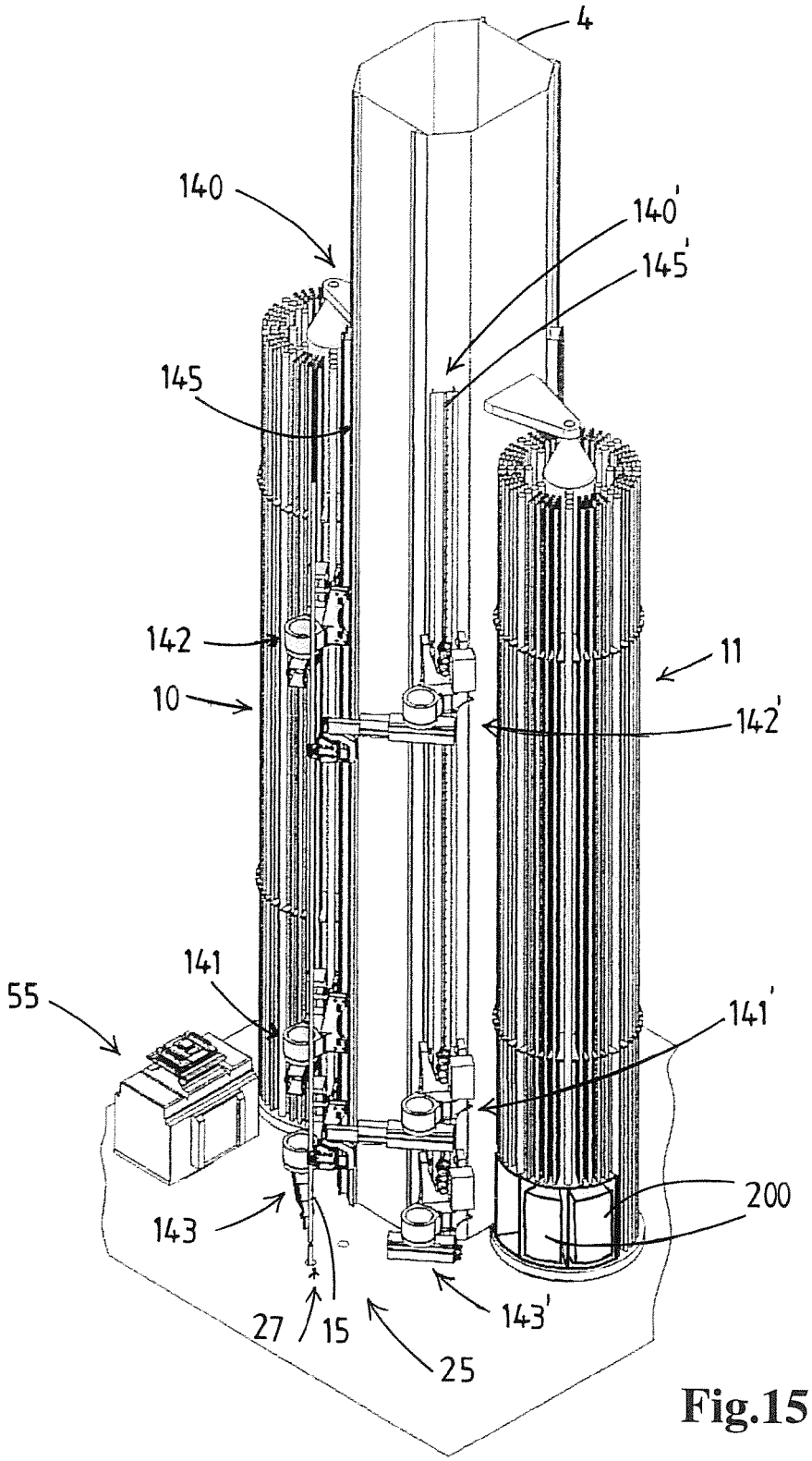
Figure 16:
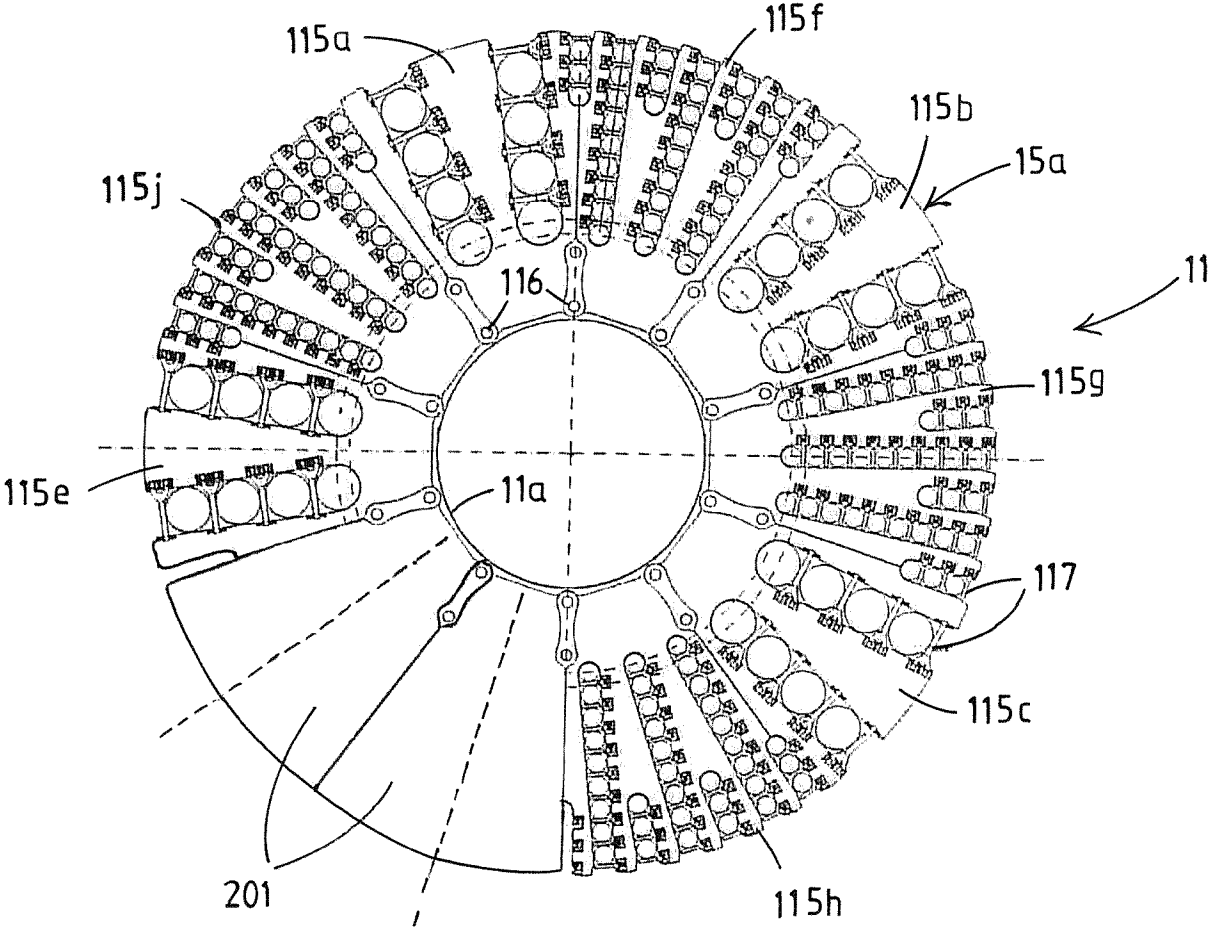

The invention will now be explained in more detail with reference to the appended drawing. In the drawing:

FIG. 1 shows a plan view of a drilling vessel with a system according to the invention, FIG. 2 shows on a larger scale a part of FIG. 1, FIG. 3 shows a perspective side view of a part of a drilling vessel with a system according to the invention, FIG. 4 shows a side view of a part of a drilling vessel with a system according to the invention, FIG. 5 shows a front view of a part of a drilling vessel with a system according to the invention, FIG. 6 shows a perspective view of a part of a drilling vessel with a system according to the invention, FIG. 7 shows a racker assembly of the system of FIG. 6, FIG. 8 shows the racker assembly of FIG. 7 in side view, partly as wire frame, FIG. 9 shows the racker assembly of FIG. 7 in top view, FIG. 10 illustrates the handling of a tubular by means of the racker assemblies with the lower assembly supporting an iron roughneck device, FIG. 11 shows in plan view a portion of the vessel of FIG. 6, FIG. 12 shows a top view of a fingerboard disc according to the second aspect of the invention, FIGS. 13*a, b* show a fingerboard disc member adapted for drill pipe and a fingerboard disc member adapted for casing respectively, without latch devices thereon, FIGS. 14*a, b* show the disc members of FIGS. 13*a, b* provided with latch devices thereon, FIG. 15 shows the part of a drilling vessel of FIG. 6, with an alternative drilling tubulars storage rack, FIG. 16 shows a top view of a fingerboard disc of FIG. 12 including a tool storage.

With reference to the FIGS. 1-5 now an embodiment of an oil and gas offshore drilling vessel equipped with a wellbore drilling system according to the invention will be explained.

The vessel 1 here is a monohull vessel having a hull 2 with a moonpool 3 extending through the hull. A drilling tower, here mast 4 is mounted on the hull, here above the moonpool 3. The mast is associated with hoisting means, in the art called drawworks, in the shown embodiment forming two firing lines 5, 6 along and on the outside of the mast, here fore and aft of the mast 4, that extend through the moonpool 3.

A drill floor 25 is provided, having a well center 27 through which a drill string passes, along the firing line, here firing line 5.

The firing line 5 is designed for performing drilling, and here includes a drill string rotary drive, here a top drive 7 or other rotary drive, adapted for rotary driving a drill string.

The vessel 1 is equipped with two drilling tubulars rotary storage racks 10, 11 adapted to store multiple drilling tubulars 15 in vertical orientation, preferably multi-jointed tubular. As can be seen in FIGS. 1 and 2 the vessel has a longitudinal central axis 300, and the drilling tubulars rotary storage racks 10, 11 are arranged symmetrical with respect to said longitudinal central axis 300, on opposite sides of the drilling mast 4.

Preferably, as visible in FIG. 5, each drilling tubulars rotary storage rack is rotatable mounted on the vessel so as to rotate about a vertical axis. In particular, drilling tubulars rotary storage rack 10 is rotatable about rotation axis 30. A lower bearing 12 is visible at the lower end of the rack, connecting the rack 10 to the hull 2. Also, as is preferred, an upper bearing 32 is present at the top end of the rack, connecting said top end to a support frame 33. Here the support frame connects the top end of the rotary rack to the mast 4.

As is known in the art each drilling tubulars rotary storage rack 10, 11 includes slots for the storage of multiple tubulars in each drilling tubulars rotary storage rack in vertical orientation. As is known in the art the racks 10, 11 here include a central vertical post 10*a*, 11*a*, and multiple disc members 15*a*, 15*b*, 15*c* at different heights of the post, at least one disc being a fingerboard disc having tubulars storage slots, each slot having an opening at an outer circumference of the fingerboard disc allowing to introduce and remove a tubular from the storage slot. It is envisaged that in a preferred embodiment the tubulars rest with their lower end on a lowermost disc member 15*d*. In the example shown in the FIGS. 1-5 it is envisaged that triple stands are stored in the racks 10, 11. The diameter of each rack 10, 11 is about 8 meters.

Also schematically indicated are drive motors 18, 19 for each of the first and second drilling tubulars rotary storage rack 10, 11 that allow to rotate the drilling tubulars storage rack about its vertical axis. In a possible embodiment the drive motors 18, 19 are embodied as part of an indexing drive for the racks, so that each of the rack can be brought in a multitude of predetermined rotary positions.

The vessel 1 also includes a horizontal catwalk machine 80 on the deck and aligned with the relevant firing line and allowing to bring tubulars from a remote position towards the firing line or to a stand-building location, e.g. from hold for horizontal storage of drilling tubulars in the aft portion of the hull and/or the deck storage. A crane 17 is provided to place tubulars on the catwalk machine 80 and remove them there from. As is preferred the catwalk machine 80 is arranged on the central longitudinal axis 300 of the vessel on the deck. The vessel 1 also includes a driller's cabin 85.

In the shown embodiment, four tubular racking devices 40, 40', 40", 40'" are provided, at all four corners of the mast 4, two adjacent each firing line 5, 6, and two adjacent each drilling tubulars rotary storage rack 10, 11:

- tubular racking device 40 is arranged to transfer tubulars between the first drilling tubulars storage rack 10 and firing line 5,
- tubular racking device 40' is arranged to transfer tubulars between the first drilling tubulars storage rack 10 and firing line 6,
- tubular racking device 40" is arranged to transfer tubulars between the second drilling tubulars storage rack 11 and firing line 5,
- tubular racking device 40'" is arranged to transfer tubulars between the second drilling tubulars storage rack 11 and firing line 6, A tubular racking device according to the invention, as in particular tubular racking device 40 as visible in FIG. 4, comprises a lower first tubular racker assembly 41, a second tubular racker assembly 42, operable at a greater height than the first tubular racker assembly, and a third tubular racker assembly 43. Although only explained in relation to tubular racker assemblies 42, 43 each tubular racker assembly comprises comprising a base 42*b*, 43*b*, a motion arm 42*m*, 43*m* connected to said base 42*b*, 43*b*; and a tubular gripper member 42*t*, 43*t* connected or connectable to the motion arm 42*m*, 43*m* and adapted to grip a tubular.

The base of the first tubular racker assembly 41 is vertically mobile between a lower operative position wherein the corresponding gripper member can place a tubular in and remove a tubular from the drilling tubulars storage rack and a raised position. The base of the third tubular racker assembly 43 is also vertically mobile, at least between a well center servicing position, that is below the lower operative position of the base of the first tubular racker assembly, and said lower operative position of the base of the first tubular racker assembly if said first tubular racker assembly is moved to a raised position. Wth the base of the third tubular racker assembly 43 in said lower operative position of the base of the first tubular racker assembly 41, and with a tubular gripper member connected to the motion arm, the third tubular racker assembly 43 is operable for tubular transfer between the firing line 5 and the drilling tubulars storage rack 10, in combination with the second tubular racker assembly 42, e.g. in case of failure of the first tubular racker assembly 41.

To provide the vertical mobility, the bases 41*b*, 43*b* are guided along a vertical rails 44. Optionally, as visible in the top view of FIGS. 1 and 2, the tubular racking devices includes a vertical column member 45, 45', 45", 45'" provided with said one or more rails, said column member 45, 45', 45", 45'" supporting said tubular racker assemblies.

Each tubular racking device 40, 40', 40", 40" is adapted to grip and retain a drilling tubular by the tubular racker assemblies, wherein the weight of the tubulars is distributed over the motion arms of the tubular racker assemblies, and wherein the tubular racking device is adapted to place a tubular in and remove a tubular from the drilling tubulars storage rack, Each tubular racking device 40, 40', 40", 40" has a reach at least allowing to transfer a tubular gripped by said first and second tubular racker assemblies between the drilling tubulars storage rack 10, 11 and a position of the tubular aligned with the firing line 5, 6 above the well center so as to allow for building and disassembly of a tubulars string, e.g. a drill string or a casing string.

The system further comprises one or more well center tools 51, 52, 53, each adapted for operation above the well center 27 of the drill floor 25. Optional well center tools are:

- an iron roughneck for making up and breaking out of threaded tubular joint,
- a raised back-up system clamp adapted to clamp a drill string top end at an elevated position above the drill floor,
- a guide sheave for one or more lines to be introduced into the well bore,
- a thread doper adapted to clean a threaded tubular end and to dope the threaded tubular end,
- a mud bucket adapted to catch mud upon tripping in order to retrieve mud allowing for re-use of the mud.

In the shown embodiment, each well center tool 51, 52, 53 is adapted to be gripped by the tubular gripper member 43*t* connected to the motion arm 43*m*.

According to a first aspect of the present invention, —with the base 43*b* of the third tubular racker assembly 43 in the well center servicing position and a well center tool 51, 52 or 53 connected to the motion arm 43*m* thereof—the well center tool 51, 52 or 53 is operable above the drill floor 25, whilst the first and second tubular racker assemblies 41, 42 are operable in combination for tubular transfer between the firing line 5 and the drilling tubulars storage rack 10. Preferably, the well center tools have identical mechanical connectors that are connectable to the motion arm 43*m*.

According to a possible embodiment of the invention, a well center tools storage structure 55 is provided that is adapted to store therein the one or more well center tools 51, 52, 53, 54*a*, 54*b* that are connectable to the motion arm 43*m* of the third tubular racker assembly 43. As is preferred and visible in FIG. 4, the well center tools storage structure 55 is adapted to store well center tools 51, 52, 53 therein at least at multiple levels above one another. It is also possible to store well center tools 54*a*, 54*b* adjacent each other as visible in top view in FIGS. 1 and 2.

Said well center tools storage structure 55 is arranged such that said one or more well center tools 51, 52, 53, 54*a*, 54*b* stored therein are within reach of the third tubular racker assembly 43 so as to allow connection of a well center tool to the motion arm 43*m* while the well center tool is stored in the well center tools storage structure 55.

With reference to FIGS. 6-11 now another embodiment of a well drilling system according to the invention will be described.

In FIG. 6 the mast 4 (shown in FIG. 6 with the top section including the drawworks and topdrive removed), the drill floor 25, and the well center 27 are shown.

Also shown are the storage racks 10, 11 for tubulars, e.g. drill pipes and casing, here multi-jointed tubulars.

At the side of the mast 4 facing the drill floor 25 two tubular racking devices 140 and 140' are mounted, each at a corner of the mast 4. If no mast is present, e.g. with a latticed derrick, a support structure can be provided to arrive at a similar arrangement of the racking devices 140 and 140' relative to the drill floor 25 and well center 27.

As is preferred each racking device 140, 140' has multiple, here three racker assemblies. Here a lower first tubular racker assembly 141, 141', a second tubular racker assembly 142, 142', operable at a greater height than the first tubular racker assembly, and a third tubular racker assembly 143, 143'.

Each set of racker assemblies is arranged on a common vertical rails 145, 145' that is fixed to the mast 4, here each at a corner thereof.

In FIG. 6, as can be better seen in the depiction of FIG. 10, a drill pipe multi-joint tubular 15 is held by racker assemblies 142' and 141' in the firing line above the well center 27, thereby allowing to connect the tubular 15 to the drill string supported, e.g., by a non-depicted drill sting slip device in or on the drill floor 25. Each of said assemblies 142' and 141' carries a tubular gripper member 142'*t* and 141'*t* at the end of the motion arm of the assembly.

The lower racker assembly 143 of the other racker device 140 carries an iron roughneck device 150, here with a spinner 151 thereon as well.

As can be seen in FIGS. 7-9 the motion arm 141*m* is here embodied a telescopic extensible arm, the arm having a first arm segment 141*m*-1 which is connected to the base 141*b* via a vertical axis bearing 147 allowing the motion arm 141*m* to revolve about this vertical axis. As is preferred this vertical axis forms the only axis of revolution of the motion arm. The motion arm has two telescoping additional arm segments 141*m*-2 and 141*m*-3, with the outer arm segment being provided with a connector 148 for a tubular gripper 141'*t* and/or a well center tool (e.g. iron roughneck device 150).

Advantageously, the telescopic extensible arm is retractable in a direction opposed to the direction of extension. As the telescopic extensible arm of this embodiment extends beyond the vertical axis bearing 147 in the direction opposed to the direction of extension, a very compact retracted position can be achieved as indicated by dashed line R in FIG. 11. The position of gripper 141'*t* below the motion arm 141*m* further attributes to the compact retracted position.

As visible in FIG. 8, in the example shown a hydraulic cylinder 152 is present between first and second segments of the arm, and a further cylinder 153 between the second and third segments of the arm. Each cylinder 152, 153 is operable to cause extension and retraction of the arm. For example the racker assembly is provided with a self-contained hydraulic unit 154 including an electric motor driven pump, a tank, and valves.

In FIGS. 6, 9 and 10 it can be recognized that each tubular racking device comprises a vertical guide rail 145 onto which corresponding guide members of the base 141*b* of each tubular racker assembly engage. In this example the base 141*b* carrier four sets of each three rollers 149 of which two rollers 149 ride along opposed faces of a flange of the rails 145 and one roller rides along a lateral side of the flange.

The tubular racker device further comprises a vertical toothed rack 160 arranged parallel to this vertical guide rails 145. Here the toothed rack 160 is mounted on the rail 145, here on a front plate of the rail between the two flanges of the rail 145.

The base 141*b* of the tubular racker assembly 141 is provided with one or more, here two, pinions 161 engaging with this vertical toothed rack 160. The base is provided with one or more motors 162, here two, driving the pinions, so as to allow for a controlled vertical motion of the racker assembly 141.

As is preferred the one or more motors 162 driving the one or more pinions 161 are electric motors. In an embodiment a supercapacitor is included in an electric power circuit feeding said one or more vertical motion motors, which allows the temporary storage of electricity that may be generated by said one or more motors during a downward motion of the assembly. This energy can then be used for the upward motion again.

In view of a reduction of the number of parts it is preferred for all motion arms to be identical, so that limited spare parts are needed. For example a single complete motion arm, or a single complete racker assembly is stored aboard the vessel.

In view of reduction of the number of parts it is preferred for the vertical axis bearing 147 between the base 141*b* and the motion arm 141*m* to be arranged in a bearing housing 147*a* that is releasable attached to the base 141*b* of the racker assembly. As depicted here the base 141*b* provides both a left-hand attachment position "L", as indicated in FIG. 7, and a right-hand attachment position, as shown in use in FIG. 7, for the bearing housing 147*a* which allows to use the same base in each of the racking devices 140 and 140'. As is preferred the attachment positions are formed by elements on the base having holes therein and the housing 147*a* having mating holes therein, so that one or more connector pins 156 can be used to secure the housing to the base.

As shown in FIG. 10 the motion arm assembly 143 holds iron roughneck device 150 above the well center for make-up or breaking up of connections between tubulars in the firing line 5. At the same time the other motion arm assembly 143' can be equipped with a second iron roughneck device, which is then already prepared for handling different diameter tubulars.

As explained, should e.g. assembly 141' fail to operate, it task can be taken over by assembly 143' on the same rails 145' as it may be quickly equipped with a tubulars gripper and brought to the level appropriate for tubulars racking. For example the assembly 141' is then raised to make room for the assembly 143'.

In FIG. 11 a fingerboard disc member 15*a* of rack 11 is shown. As can be seen the rack 11 is arranged along a lateral side of the mast 4, with the drill floor 25 with firing line 5 forward of the mast 4 and with a riser handling side rearward of the mast 4.

As can be seen it is, in embodiments, envisaged that one or more racker devices and/or assemblies thereof as described in this application are present at said riser handling side, here assembly 141''' —opposite the drilling side (where assembly 141' is provided)—of the mast 4. For example a riser gripper tool may be arranged in storage structure 55'' to be mechanically interconnected to the motion arm of assembly 141''' in the manner as described herein. Another tool that may be of use at the riser handling side of the mast is e.g. a bolting tool to tighten or release bolts interconnecting riser sections. As is preferred a further vertical rails 145''' is present at said riser handling side as well.

The fingerboard disc 15*a* is embodied according to a second aspect of the invention is shown, which is provided around a central vertical post 11*a*. The fingerboard disc 15*a* comprises multiple tubulars storage slots, each slot having an opening at an outer circumference of the fingerboard disc allowing to introduce and remove a tubular from the storage slot.

Figure 13B:
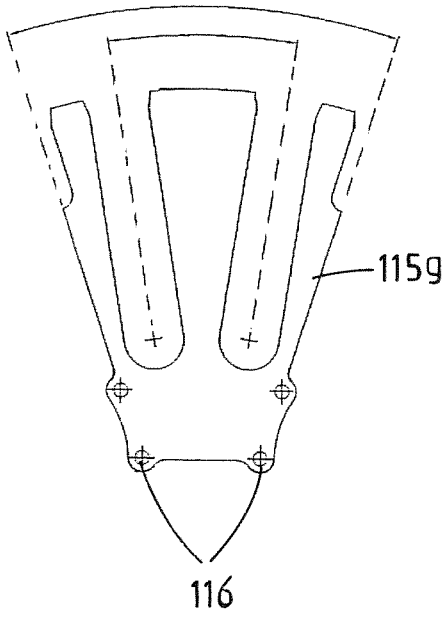
Figure 14B:
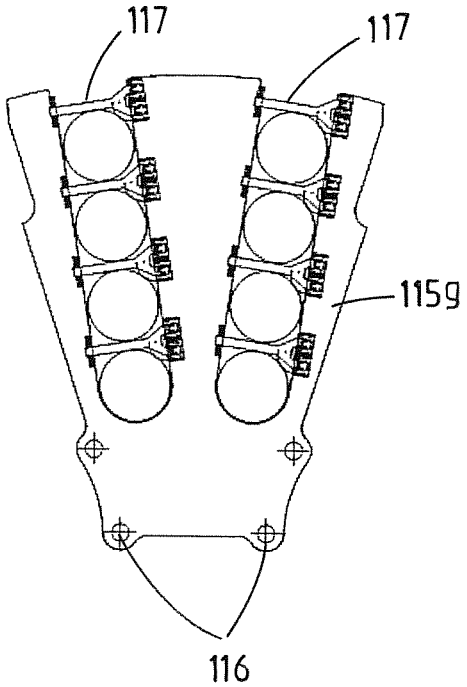

As will be explained now in more detail with reference to FIGS. 12, 13, and 14, the fingerboard disc 15*a* is composed of multiple fingerboard disc members, here ten fingerboard disc members 115*a*-115*j*.

As in a preferred embodiment of the second aspect of the invention, some disc members 115*a*—*e* have slots of a first width, here to accommodate casing pipes, and some disc members 115*f*—*j* have slots of a second different width, here to accommodate drill pipes. As can be seen it is envisaged that adjacent disc members may form a further slot at their interfacing sides.

As is preferred disc members provided with different width slots are identical as to their inner connection portion that is adapted to be connected to the central post 11*a* and as to their sides that adjoin the neighboring disc members, so as to allow for any combination of disc members in the disc 15*a*, thereby allowing to optimize the storage capacity of the rack 11 in view of the operation performed with the vessel. For example each disc member has sides diverging at a 36 degree angle so that ten disc members make up an entire disc. Of course it will also be possible to divide the disc 15*a* in a different number of disc members, e.g. eight or twelve disc members.

As is preferred all disc members have an identical connector portion adapted to connect the disc member to the central post 11*a*. As is preferred each disc member has at its inner end a series of holes 116 through which bolts or pins can be fitted to secure the disc to the central post 11*a*.

In an embodiment a disc member 115*a*—*f* has three deep slots and between two deep slots a slot of reduced depth, e.g. the deep slots accommodating nine drill pipe stands and the reduced depth slot accommodating three drill pipe stands.

In an embodiment a disc member 115*g*—*i* has two deep slots to accommodate casing pipe stands, e.g. four per slot.

As shown in FIGS. 14*a, b* it is envisaged that a disc member 115*a*—*f*, 115*g*—*i* may be pre-fitted with a latch device having latch members that secure each tubular at a location of the slot, e.g. (as in this example), each latch member having a pivotal latch finger 117 that extends across the slot in a securing position and can be pivoted to a release position, e.g. by an associated actuator, e.g. a pneumatic or hydraulic cylinder.

As explained here, it is envisaged that a disc member 115*a*—*i* can be gripped or otherwise engaged by a tubular racker assembly and moved along the height of the tower by means of said assembly, e.g. in the process of exchanging disc members to alter the storage capacity of the rack. For example a retainer can be slided into a slot of the disc, the retainer having a pipe stub that can be gripped by a tubular gripper so the disc is effectively held by the retainer and can be conveyed along the height of the tower.

In FIG. 15 the part of a drilling vessel of FIG. 6 is shown, wherein the drilling tubulars storage rack 11 is at its bottom part provided with a tool storage structure 200. The rack is accordingly used for shorter tubulars than rack 10. Other configurations are also conceivable, e.g. wherein the tool storage structure is provided at a central part of the drilling tubulars storage rack 11, and short (single) tubulars are stored above and below the tool storage structure 200. Preferably at least two tubular racker assemblies of a tubular racking device can reach into the tool storage structure. An advantage of the tool storage structure in the drilling tubulars storage rack 11 is that tubular racking devices of both sides of the mast 4 can reach into the tool storage structure 200.

In FIG. 16 a top view of an alternative fingerboard disc is shown, including tool storage compartments 201, in the shown embodiment two. It is conceivable that the entire segments are tool storage compartments, but it is also conceivable that an upper or bottom part of the segment is also adapted to store tubulars.

The invention claimed is:

1. A wellbore drilling system comprising:

a drilling tower;

a drill floor having a well center through which a drill string passes along a firing line;

a drilling tubulars storage rack adapted to store multiple drilling tubulars in vertical orientation; and a tubular racking device having at least a lower first tubular racker assembly, a second tubular racker assembly operable at a greater height than the first tubular racker assembly and a third tubular racker assembly, each tubular racker assembly comprises a base, a motion arm connected to said base, and a tubular gripper member connected or connectable to the motion arm and adapted to grip a tubular, wherein said tubular racking device is adapted to grip and retain a drilling tubular by the tubular racker assemblies, and wherein said tubular racking device is adapted to place a tubular in and remove a tubular from the drilling tubulars storage rack, wherein said tubular racking device has a reach at least allowing to transfer a tubular gripped by said first and second tubular racker assemblies between the drilling tubulars storage rack and a position of the tubular aligned with the firing line above the well center so as to allow for building and disassembly of a tubulars string, wherein the system further comprises one or more well center tools, each adapted for operation above the well center of the drill floor, wherein the base of the first tubular racker assembly is vertically mobile between a lower operative position —wherein the corresponding gripper member can place a tubular in and remove a tubular from the drilling tubulars storage rack —and a raised position, wherein the base of the third tubular racker assembly is vertically mobile at least between a well center servicing position, that is below the lower operative position of the base of the first tubular racker assembly, and said lower operative position of the base of the first tubular racker assembly if said first tubular racker assembly is moved to a raised position, wherein —with the base of the third tubular racker assembly in said lower operative position of the base of the first tubular racker assembly and with a tubular gripper member connected to the motion arm —the third tubular racker assembly is operable for tubular transfer between the firing line and the drilling tubulars storage rack in combination with the second tubular racker assembly, wherein at least one of the one or more well center tools is adapted to be connected to the motion arm of the third tubular racker assembly, wherein a first well center tool of the at least one of the one or more well center tools is a first iron roughneck device for making up and breaking out of threaded tubular joints, and wherein —with the base of the third tubular racker assembly in the well center servicing position —a well center tool of the at least one of the one or more well center tools is connected to the motion arm thereof and is operable above the drill floor, whilst the first and second tubular racker assemblies are operable in combination for tubular transfer between the firing line and the drilling tubulars storage rack.

2. The wellbore drilling system according to claim 1, wherein the system further comprises a well center tools storage structure that is adapted to store therein the at least one of the one or more well center tools that are connectable to the motion arm of the third tubular racker assembly.

3. The wellbore drilling system according to claim 2, wherein the well center tools storage structure is adapted to store well center tools therein at least at multiple levels above one another.

4. The wellbore drilling system according to claim 2, wherein said well center tools storage structure is arranged such that said at least one of the one or more well center tools stored therein are within reach of the third tubular racker assembly so as to allow connection of a well center tool to the motion arm while the well center tool is stored in the well center tools storage structure.

5. The wellbore drilling system according to claim 1, wherein a first and a second drilling tubulars storage rack is provided on opposite sides of the drilling tower, and wherein said tubular racking device is a first tubular racking device and is arranged to transfer tubulars between the first drilling tubulars storage rack and the firing line, and wherein a second tubular racking device is arranged to transfer tubulars between the second drilling tubulars storage rack and the firing line.

6. The wellbore drilling system according to claim 5, wherein the system further comprises a well center tools storage structure that is adapted to store therein the at least one of the one or more well center tools that are connectable to the motion arm of the third tubular racker assembly, wherein the well center tools storage structure is adapted to store well center tools therein at least at multiple levels above one another, and wherein said well center tools storage structure is arranged such that said at least one of the one or more well center tools stored therein are within reach of the third tubular racker assembly so as to allow connection of a well center tool to the motion arm while the well center tool is stored in the well center tools storage structure, the wellbore drilling system further comprising a first well center tool storage structure arranged such that said one or more well center tools stored therein are within reach of said first tubular racking device, and comprising a second well center tool storage structure arranged such that one or more well center tools stored therein are within reach of the second tubular racking device.

7. The wellbore drilling system according to claim 6, wherein a second well center tool of said one or more well center tools comprises a second iron roughneck device, wherein the first and second iron roughneck devices are adapted for different diameter tubular strings, and wherein the first iron roughneck device is stored in the first well center tool storage structure and wherein the second iron roughneck device is stored in the second well center tool storage structure.

8. The wellbore drilling system according to claim 1, wherein the bases of the first, second and third tubular racker assemblies are guided along a common vertical rail.

9. The wellbore drilling system according to claim 1, wherein the drilling tubulars storage rack is a drilling tubulars rotary storage rack that is rotatable about a vertical axis and has storage slots for storage of multiple tubulars in vertical orientation, the drilling tubulars rotary storage rack includes a drive to rotate the drilling tubulars storage rack about its vertical axis.

10. The wellbore drilling system according to claim 9, wherein the drilling tubulars rotary storage rack comprises a central vertical post and multiple discs at different heights on the post, at least one disc being a fingerboard disc having tubulars storage slots, each slot having an opening at an outer circumference of the fingerboard disc allowing the introduction and removal of a tubular from the storage slot, and wherein the at least one fingerboard disc is composed of multiple fingerboard disc members that are releasably connected to the central post.

11. The wellbore drilling system according to claim 10, wherein at least one fingerboard disc member is provided with a latching device adapted to latch each individual tubular held in a slot of the fingerboard disc member.

12. The wellbore drilling system according to claim 10, wherein at least one tubular racker assembly is vertically mobile and is configured to retain one fingerboard disc member from the at least one fingerboard disc during mounting and/or dismounting of the fingerboard disc member from the vertical post, and is used for vertical transportation of the gripped fingerboard disc member.

13. An offshore drilling vessel comprising:

a hull; and the wellbore drilling system according to claim 1.

14. The offshore drilling vessel according to claim 13, wherein a moonpool is present in the hull, and wherein the drilling structure is a mast at or near the moonpool with the firing line along and on the outside of the mast.

15. A method for drilling, comprising the step of using the wellbore drilling system according to claim 1.

16. The method for drilling according to claim 15, further comprising the following steps:

gripping a tubular in the drilling tubulars storage rack by the first and second tubular racker assemblies;

retaining and removing a tubular from the drilling tubulars storage rack, and transferring the tubular to a position wherein the tubular is aligned with the firing line above the well center so as to allow for building of a tubulars string;

retaining one well center tool from the at least one of the one or more well center tools by means of the third racker assembly above the well center, with the base of the third tubular racker assembly in the well center servicing position; and operating the retained well center tool above the drill floor.

17. The method according to claim 16, wherein the retained well center tool is an iron roughneck device, and wherein the method comprises the step of making up a connection using the retained well center tool between a string held in the well center and the tubular retrieved by the first and second tubular racker assemblies.

* * * * *